US009127906B2

(12) United States Patent
Wells et al.

(10) Patent No.: US 9,127,906 B2
(45) Date of Patent: Sep. 8, 2015

(54) ACCESSORY MOUNTING HAND GUARD FOR FIREARM

(71) Applicant: SureFire, LLC, Fountain Valley, CA (US)

(72) Inventors: William Wells, Costa Mesa, CA (US); Michael D. Picciotta, Yorba Linda, CA (US); George Syrengelas, Garden Grove, CA (US); Lance Graham, Oceanside, CA (US)

(73) Assignee: SureFire, LLC, Fountain Valley, CA (US)

( * ) Notice: Subject to any disclaimer, the term of this patent is extended or adjusted under 35 U.S.C. 154(b) by 0 days.

(21) Appl. No.: 13/739,478

(22) Filed: Jan. 11, 2013

(65) Prior Publication Data

US 2013/0276341 A1 Oct. 24, 2013

Related U.S. Application Data

(63) Continuation-in-part of application No. 13/451,755, filed on Apr. 20, 2012, now Pat. No. 8,595,970.

(51) Int. Cl.
*F41C 23/16* (2006.01)
*F41G 11/00* (2006.01)

(52) U.S. Cl.
CPC ..... *F41C 23/16* (2013.01); *F41G 11/003* (2013.01); *Y10T 29/49826* (2015.01); *Y10T 29/49963* (2015.01)

(58) Field of Classification Search
CPC ..... F41C 23/16; F41C 23/22; F41C 23/04; F41G 11/003; Y10T 29/49826; Y10T 29/49963
USPC ..... 42/94, 90, 72, 85, 71.01, 111, 84, 146, 42/14, 148; 89/14.1, 191.01, 1.4, 125, 89/193; 29/428, 525.01; 362/110
See application file for complete search history.

(56) References Cited

U.S. PATENT DOCUMENTS 6,508,027 B1 * 1/2003 Kim ..... 42/124
D477,855 S 7/2003 Selvaggio
6,671,990 B1 1/2004 Booth (Continued)

FOREIGN PATENT DOCUMENTS

WO WO 2008/103193 8/2008

OTHER PUBLICATIONS http://blogs.militarytimes.com/gearscout/2012/01/18/noveske-nsr-11/ published Jan. 18, 2012.*

(Continued)

*Primary Examiner* — Samir Abdosh
*Assistant Examiner* — John D Cooper
(74) *Attorney, Agent, or Firm* — Haynes and Boone, LLP

(57) ABSTRACT

Hand guards for firearms and related methods are provided. In one example, a hand guard includes an elongated housing. The elongated housing comprises a lumen configured to substantially surround an intermediate portion of a barrel of a firearm, a lateral side wall, and a pair of inclined side walls respectively disposed on opposite sides of and inclined relative to the lateral side wall. Each of the inclined side walls comprises an elongated slot, wherein the elongated slots of the inclined side walls define a pair of angulated faces of a rail adapted to receive an accessory to be mounted thereon. For example, the rail may be a reduced-height Picatinny rail provided by the lateral side wall of the housing.

34 Claims, 23 Drawing Sheets

(56) References Cited

U.S. PATENT DOCUMENTS

| | | | | |
|---|---|---|---|---|
| 6,779,288 | B1 * | 8/2004 | Kim | 42/72 |
| 7,191,557 | B2 * | 3/2007 | Gablowski et al. | 42/72 |
| 7,216,451 | B1 | 5/2007 | Troy | |
| D556,289 | S | 11/2007 | Yu | |
| 7,363,741 | B2 * | 4/2008 | DeSomma et al. | 42/85 |
| D590,473 | S | 4/2009 | Fitzpatrick et al. | |
| D606,614 | S | 12/2009 | Fitzpatrick et al. | |
| D636,453 | S | 4/2011 | Fitzpatrick et al. | |
| 7,941,959 | B1 | 5/2011 | Swan | |
| D639,376 | S | 6/2011 | Ding | |
| 8,091,265 | B1 | 1/2012 | Teetzel et al. | |
| D656,215 | S | 3/2012 | Fitzpatrick et al. | |
| D670,782 | S | 11/2012 | Barrett | |
| 8,336,243 | B2 | 12/2012 | Langevin et al. | |
| 8,453,364 | B2 | 6/2013 | Kucynko | |
| D699,807 | S | 2/2014 | Lee | |
| D702,792 | S | 4/2014 | Burt et al. | |
| D703,286 | S | 4/2014 | Chen et al. | |
| 8,726,558 | B1 | 5/2014 | Nason | |
| 8,769,853 | B1 | 7/2014 | LaRue | |
| D721,407 | S | 1/2015 | Chu | |
| 8,925,236 | B1 | 1/2015 | Mayberry et al. | |
| 8,931,196 | B1 | 1/2015 | LaRue | |
| D722,356 | S | 2/2015 | Keller et al. | |
| 2008/0301994 | A1 * | 12/2008 | Langevin et al. | 42/71.01 |
| 2009/0038198 | A1 * | 2/2009 | Yu | 42/90 |
| 2010/0319231 | A1 * | 12/2010 | Stone et al. | 42/71.01 |
| 2011/0107643 | A1 | 5/2011 | Fitzpatrick et al. | |
| 2011/0252625 | A1 * | 10/2011 | Daniel | 29/525.01 |
| 2012/0111183 | A1 | 5/2012 | Hochstrate et al. | |
| 2012/0180358 | A1 * | 7/2012 | Samson et al. | 42/71.01 |
| 2012/0324775 | A1 * | 12/2012 | Troy et al. | 42/71.01 |
| 2014/0130390 | A1 | 5/2014 | Geissele | |

OTHER PUBLICATIONS

U.S. Appl. No. 29/441,983, filed Jan. 11, 2013, inventors: Wells et al., 11 pages.

U.S. Appl. No. 13/451,755, filed Apr. 20, 2012, inventors: Picciotta et al., 26 pages.

U.S. Appl. No. 29/479,013, filed Jan. 10, 2014, inventors: Wells et al., 10 pages.

* cited by examiner

ACCESSORY MOUNTING HAND GUARD FOR FIREARM

CROSS-REFERENCE TO RELATED APPLICATIONS

This application is a continuation-in-part of U.S. patent application Ser. No. 13/451,755 filed Apr. 20, 2012 entitled "ACCESSORY MOUNTING HAND GUARD FOR FIREARM" which is hereby incorporated by reference in its entirety.

BACKGROUND

1. Technical Field

This invention relates to firearms in general, and in particular, to hand guards for firearms that enable various accessories to be mounted thereon reliably and efficiently.

2. Related Art

Firearms, such as the M16 and M4 rifles adopted for use by the U.S. military services, typically incorporate a hand guard made of a plastic or composite material, by which the shooter can effectively grasp a forward portion of the barrel of the weapon, e.g., for carrying, aiming and shooting the weapon effectively. Additionally, it is recognized that such firearms can often benefit from a variety of shooting accessories coupled to the weapon, such as lights for illuminating targets or sighting devices, e.g., laser targeting devices. Responsively, the prior art is replete with examples of devices, including hand guards adapted to replace the stock hand guard provided on the rifle, that are designed to enable one or more accessories to be coupled to the weapon.

However, these prior art devices and hand guards are not free of problems. For example, some rely on complicated mechanisms for coupling the hand guards to the rifle that can result in an unreliable mounting of the hand guard on the rifle, typically accompanied by a lengthy amount of time needed to mount the hand guard on the weapon. In other instances in which the hand guard mounts on the barrel of the rifle, the forces applied to the barrel in mounting the hand guard to it can twist or deform the barrel such that the accuracy of the rifle is adversely affected.

Accordingly, a need exists for hand guard designs that enable a variety of useful accessories to be mounted on a firearm, together with methods for mounting the hand guards on the firearm quickly, reliably and without adversely affecting their accuracy.

SUMMARY

In accordance with various embodiments described herein, hand guards that permit a variety of useful accessories to be mounted on firearms are provided, together with methods for mounting the hand guards on the firearms quickly, reliably and without adversely affecting their accuracy.

In one embodiment, a hand guard for a firearm, such as a rifle, includes an elongated tubular housing comprising an upper part, a lower part, opposite open ends, and an elongated lumen configured to receive an intermediate portion of a barrel of a firearm longitudinally therein. An expansion collar is disposed at one end of the housing. The expansion collar includes an expansion mechanism configured to adjustably compress the expansion collar and the lower part of the housing longitudinally between a pair of surfaces respectively disposed at opposite ends of the intermediate portion of the barrel.

In another embodiment, a method for using a hand guard with a firearm comprises providing an elongated tubular housing comprising an upper part, a lower part, opposite open ends, and a lumen configured to receive an intermediate portion of a barrel of the firearm longitudinally therein. An expansion collar is also provided. The collar has a longitudinally extending tongue and an expansion mechanism configured to adjustably compress the expansion collar and the lower part of the housing longitudinally between a pair of surfaces respectively disposed at opposite ends of the intermediate portion of the barrel. The tongue of the collar is inserted into an end of the housing to form an assembly, and the assembly is mounted onto a lower surface of the intermediate portion of the barrel and between the surfaces thereon. The expansion mechanism of the collar is then adjusted such that the assembly is held in compression between the surfaces.

In another embodiment, a hand guard includes an elongated housing. The elongated housing comprises a lumen configured to substantially surround an intermediate portion of a barrel of a firearm, a side wall, and a pair of elongated slots disposed on opposite sides of the side wall. Each of the elongated slots defines a corresponding angulated face of a rail adapted to receive an accessory to be mounted thereon. For example, the rail may be a reduced-height Picatinny rail provided by the side wall of the housing.

In another embodiment, a method includes inserting at least a portion of an expansion collar into an end of a part of a housing to form an assembly; positioning the assembly over an intermediate portion of a barrel of a firearm and between opposing surfaces thereon; and adjusting an expansion mechanism of the expansion collar such that the assembly is held in compression between the opposing surfaces by advancing a plurality of longitudinally extending screws respectively received in corresponding ones of a plurality of bores contained in the expansion collar such that a distal end of each screw is disposed in abutment with a bottom end surface of a corresponding one of the bores and at least a portion of each screw is loaded in compression.

The scope of the invention is defined by the claims, which are incorporated into this section by reference. A more complete understanding of embodiments of the invention will be afforded to those skilled in the art, as well as a realization of additional advantages thereof, by a consideration of the following detailed description of one or more embodiments. Reference will be made to the appended sheets of drawings that will first be described briefly.

BRIEF DESCRIPTION OF THE SEVERAL VIEWS OF THE DRAWINGS

Embodiments of the invention and their advantages are best understood by referring to the detailed description that follows. It should be appreciated that like reference numerals are used to identify like elements illustrated in one or more of the figures.

DETAILED DESCRIPTION

Figure 1A:
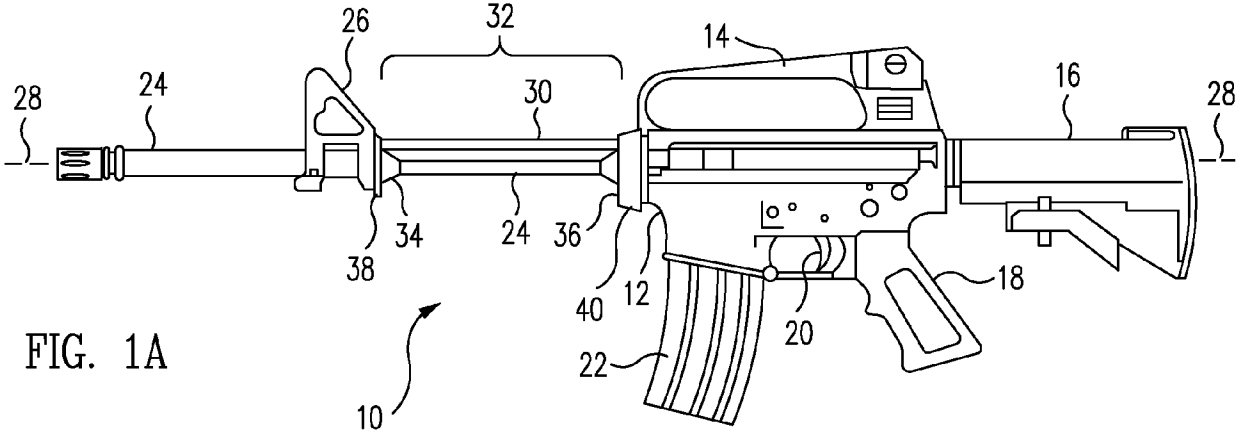
FIG. 1A is left side elevation view of an example firearm, namely, an M-16 rifle, of a type to which various hand guards of the present disclosure may be advantageously applied, in which a conventional hand guard has been omitted to reveal a gas tube and an intermediate portion of a barrel thereof, in accordance with an embodiment of the disclosure.

FIG. 1A is left side elevation view of an example firearm, namely, an M-16 rifle 10, of a type with which embodiments of the novel hand guard of the present disclosure can be advantageously utilized. The M16, and a variant thereof, viz., the M4, has generally replaced the M14 and M1 carbine as the standard infantry rifles of the U.S. armed forces. Currently, the M16 is the most commonly manufactured 5.56×45 mm rifle in the world, and is in use by 15 NATO countries and more than 80 countries worldwide. Numerous companies in the United States, Canada, and China have, together, produced more than 8,000,000 M-16 rifles, in all of its many variants, of which approximately 90% are still in operation.

As can be seen in FIG. 1A, the example rifle 10 includes a receiver 12 having a combined carrying handle and rear sight 14, a rear or shoulder stock 16 extending rearwardly from the receiver 12, a pistol-type hand grip 18, a trigger 20 for firing the rifle 10, a magazine 22 for holding ammunition, an elongated barrel 24 extending forwardly from the receiver 12, an upstanding front sight 26 mounted forwardly on the barrel 24, and a longitudinal axis 28 concentric with the barrel 24. Extending rearwardly from the front sight 26 to the receiver 12 is a gas tube 30 that conveys combustion gases from a port (not seen in FIG. 1A) in the barrel 24 located below the front sight 26 to the receiver 12, which are used by components in the receiver for the automatic actuation of the rifle 10 when it is fired.

The example rifle 10 also conventionally includes a hand guard, typically made of a plastic composite, that surrounds the gas tube 30 and an intermediate portion 32 of the barrel 24. However, in FIG. 1A, the conventional hand guard has been omitted for purposes of explication. As illustrated in FIG. 1A, the intermediate portion 32 of the barrel 24 includes a pair of front and rear radial surfaces 34 and 36 respectively disposed at opposite ends thereof. The front radial surface 34 comprises the rear surface of a hand guard forward support cap 38, and the rear radial surface 36 comprises the front surface of a threaded hand guard rear slip ring retainer 40 (also referred to as a barrel nut). As discussed in more detail below, the two radial surfaces 34 and 36 disposed at the opposite ends of the intermediate portion 32 of the barrel 24 can, in some embodiments, provide features that are advantageous for mounting a hand guard 100 in accordance with the present disclosure on the rifle 10.

Figure 1B:
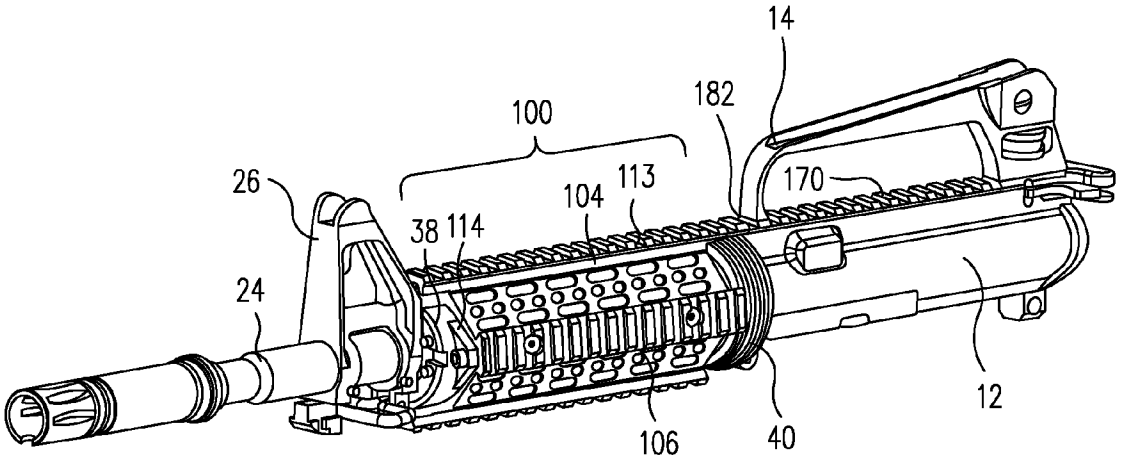
FIG. 1B is an upper, front, left side perspective view of the receiver and barrel of the rifle of FIG. 1A, showing a first example embodiment of a hand guard in accordance with the present disclosure mounted thereon.
Figure 2:
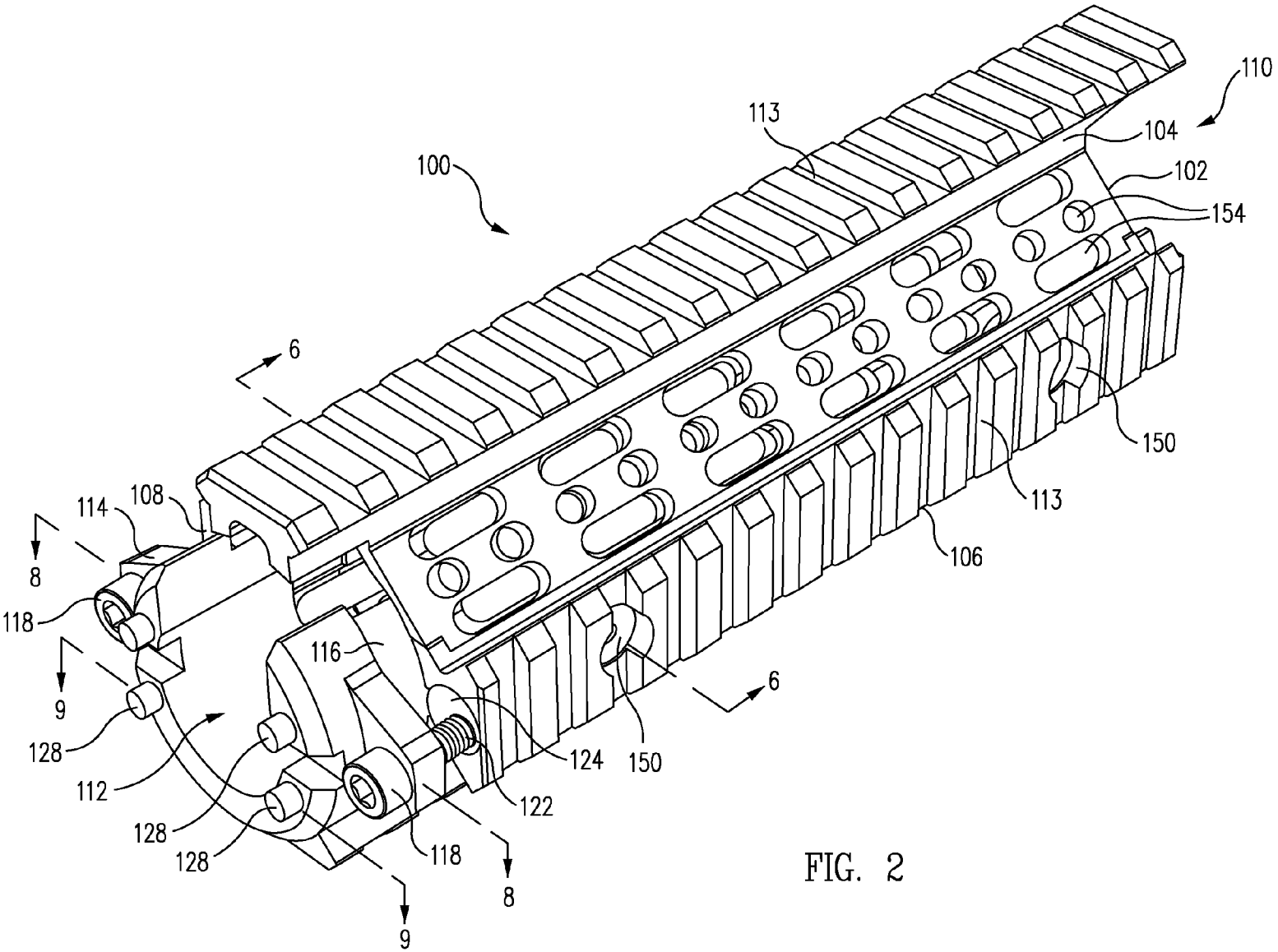
FIG. 2 is an upper, front, left side perspective view of the first example hand guard of FIG. 1B.
Figure 3:
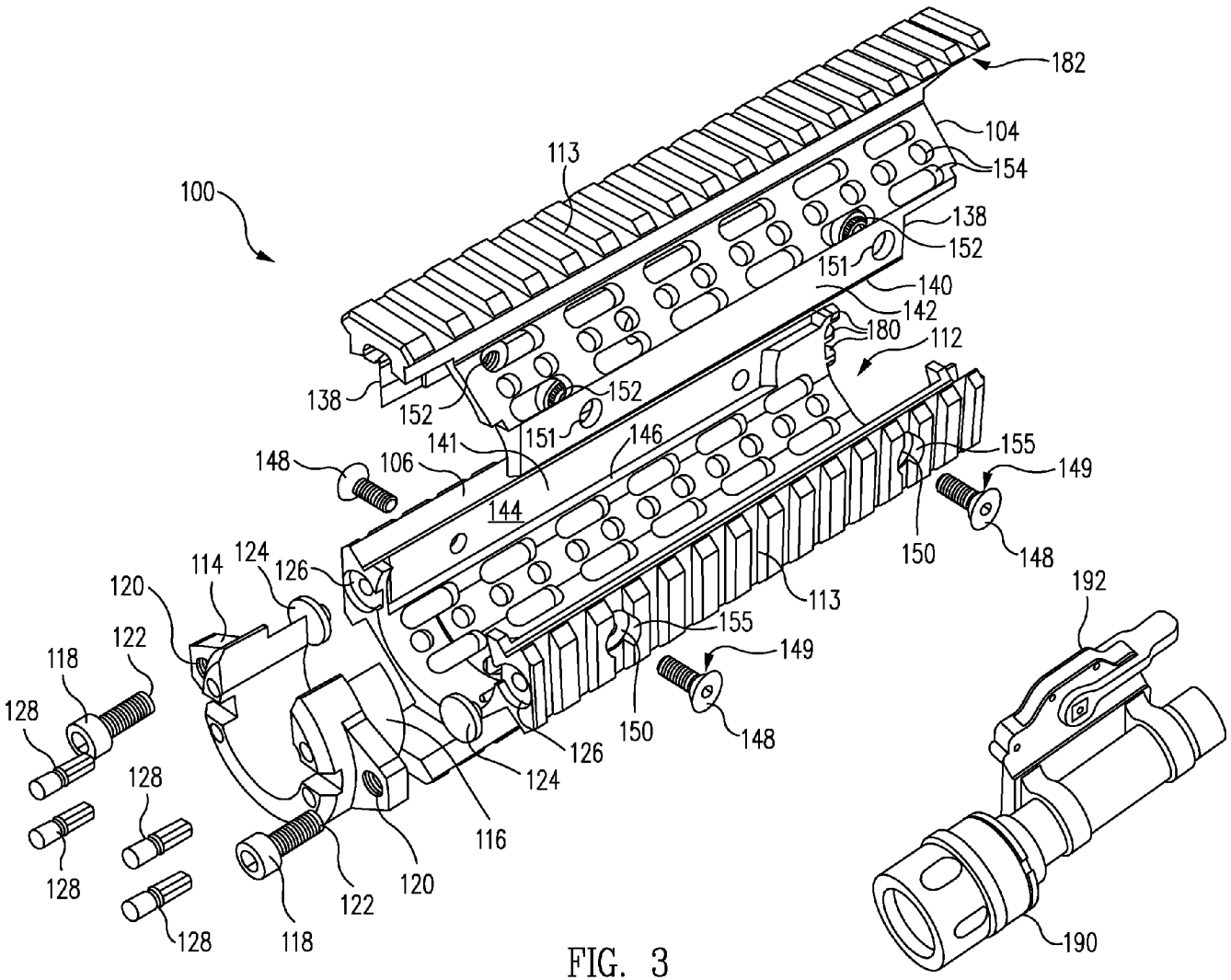
FIG. 3 is an upper, front, left side exploded perspective view of the first example hand guard, showing an upper part, a lower part, and an expansion collar thereof.
Figure 4A:
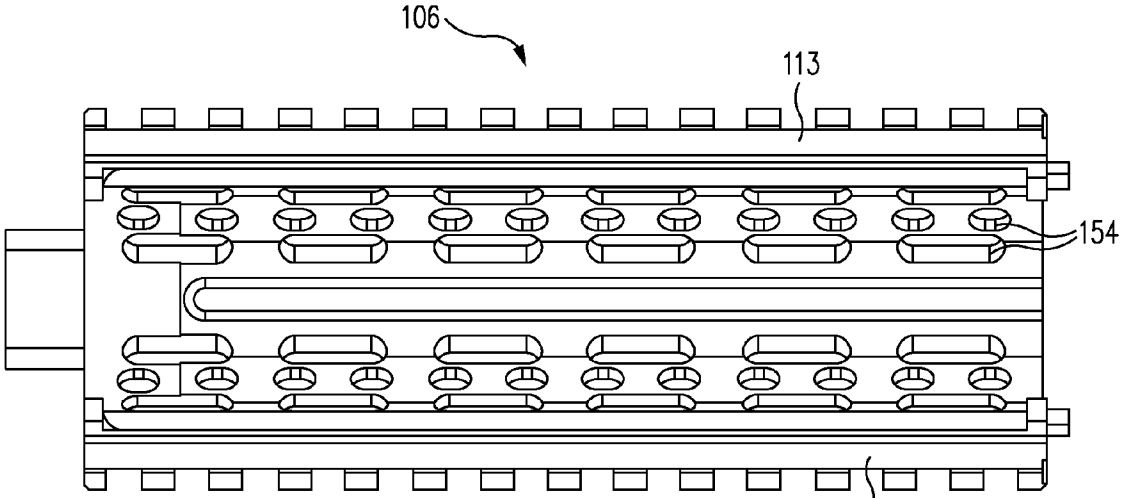
FIG. 4A is top plan view of the lower part of the first example hand guard.
Figure 4B:
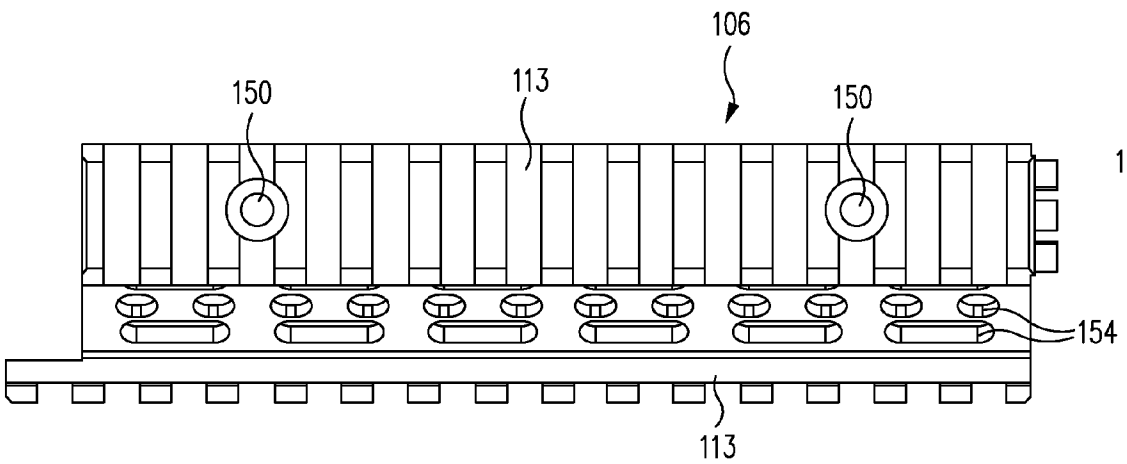
FIG. 4B is a left side elevation view of the lower part.
Figure 4C:
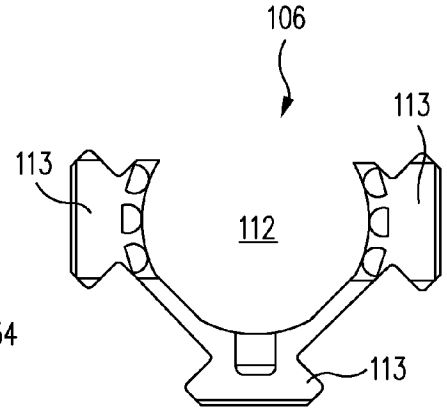
FIG. 4C is a rear end elevation view of the lower part.
Figure 4E:
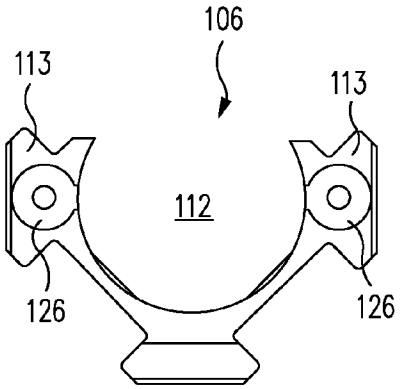
FIG. 4E is a front end elevation view of the lower part.
Figure 4D:
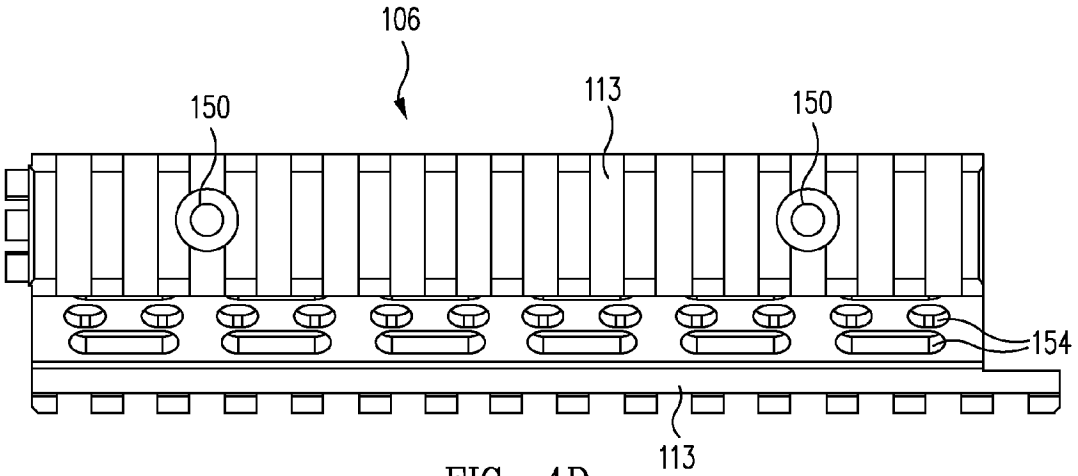
FIG. 4D is a right side elevation view of the lower part.
Figure 4F:
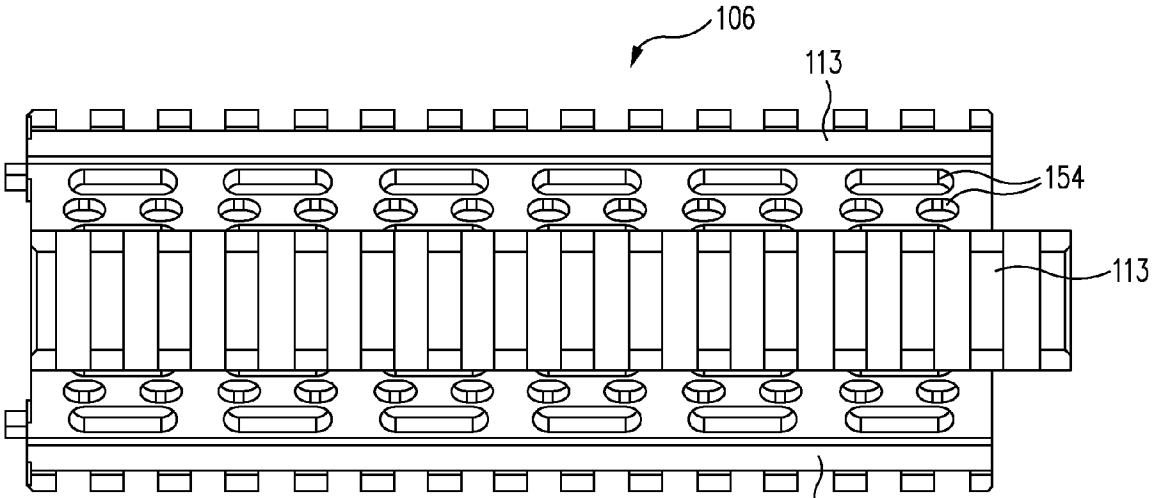
FIG. 4F is a bottom plan view of the lower part.

FIG. 1B is an upper, front, left side perspective view of the receiver 12 and barrel 24 of the rifle 10 of FIG. 1A, showing a first example embodiment of a hand guard 100 in accordance with the present disclosure mounted thereon. FIGS. 2 and 3 are upper, front, left side perspective and exploded perspective views of the example hand guard 100, respectively. As illustrated in FIGS. 2 and 3, the example hand guard 100 comprises an elongated tubular housing 102 having an upper part 104, a lower part 106, opposite open ends 108 and 110, and a lumen 112 configured to receive the gas tube 30 and intermediate portion 32 of the barrel 24 of the firearm 10 longitudinally therein.

Figure 6:
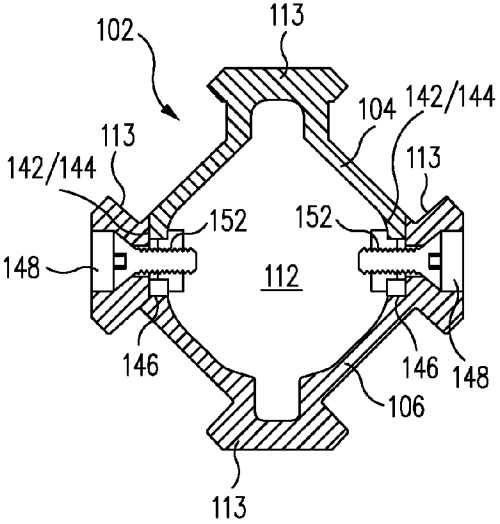
FIG. 6 is a cross-sectional view through the first example hand guard, as seen along the lines of the section 6-6 taken in FIG. 2.
Figure 5F:
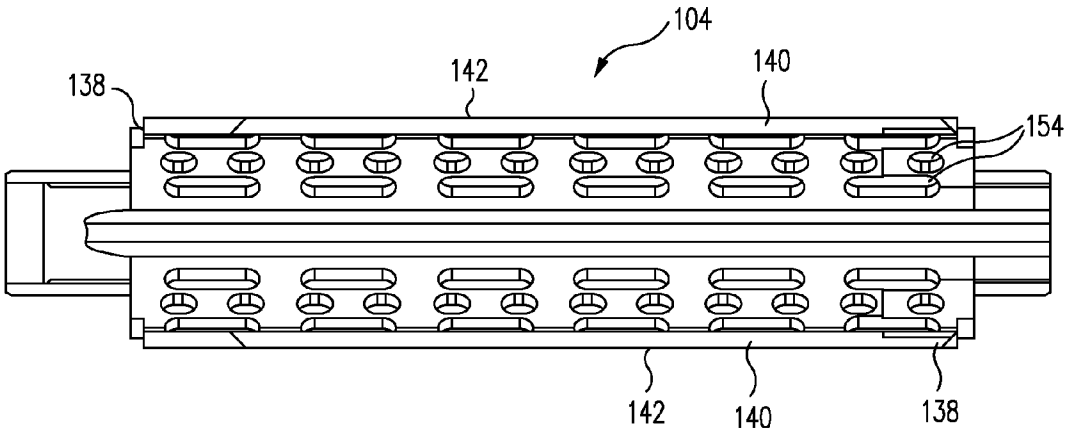
FIG. 5F is a lower plan view of the upper part.

As illustrated in the cross-sectional view of the housing 102 in FIG. 6, the housing 102 can have a generally polygonal cross-section, and in the particular embodiment illustrated, the housing 102 has eight side walls, i.e., is octagonal in cross-sectional shape. Other cross-sectional shapes, including round or annular, can also be used. At least one of the side walls of the housing 102 can comprise a longitudinal accessory mounting rail 113, such as specified in MIL-STD-1913 and commonly referred to as a "Picatinny" rail, or other type of rail. In the particular example embodiment illustrated in FIG. 6, four such accessory mounting rails 113 are provided, disposed in alternating fashion around the circumfery of the housing 102, one comprising the top side wall of the upper part 104 of the housing 102, and three comprising the two lateral and one bottom side walls of the lower part 106 thereof.

As shown in FIG. 1B, when hand guard 100 is installed on receiver 12, a top rail 113 on upper part 104 may be substantially level with another rail 170 (e.g., another longitudinal accessory mounting rail such as another Picatinny rail or other type of rail). Such positioning of rails 113 and 170 may advantageously permit various accessories to be mounted substantially in line with each other on rails 113 and 170 and/or permit such accessories to be mounted across both rails 113 and 170 (e.g., using mounting locations of both rails 113 and 170).

One or more accessories many be mounted on rails 113 such as, for example, lighting devices, sighting devices, and/or others. For example, as identified in FIG. 3, a lighting device 190 (e.g., a SureFire Scout Light in one embodiment) may be provided to be mounted on rails 113 (e.g., directly and/or with a rail clamp 192, such as a SureFire M93 Swing-Lever WeaponLight Rail Clamp in one embodiment and/or as identified in U.S. Pat. No. 8,127,484 which is hereby incorporated by reference in its entirety).

In some embodiments, upper part 104 may include one or more protrusions 182 (e.g., one or more flanges or individual protruding members) configured to engage or contact receiver 12 (see FIGS. 1B and 3). For example, protrusion 182 may extend over, rest upon, and/or push against various external portions of retainer 40 and/or of rear sight 14. In some embodiments, lower part 106 may include one or more protrusions 180 (e.g., implemented as one or more flanges or individual protruding members) configured to engage or contact receiver 12 (see FIGS. 1B and 3). For example, protrusions 180 may rest upon and/or push against retainer 40. In various embodiments, protrusions 180 and/or flanged portion 182 may be used to further secure hand guard 100 to rifle 10.

As illustrated in FIGS. 2, 3, 8, and 9, the example hand guard 100 further comprises an expansion collar 114 disposed at one end of the housing 102. The expansion collar 114 incorporates an expansion mechanism, described below, configured to adjustably compress the expansion collar 114 and the lower part 106 of the housing 102 longitudinally between the radial surfaces 34 and 36 located at opposite ends of the intermediate portion 32 of the barrel 24, as described above. In the particular embodiment illustrated in the figures, the expansion collar 114 is shown disposed adjacent to the front end 108 of the housing 102, but as those of some skill in the art will appreciate, this arrangement can be reversed, such that the expansion collar 114 is disposed adjacent to the rear end 110 of the housing 102.

Additionally, as illustrated in, e.g., FIGS. 2, 3, 7A, 7C, and 7D, the expansion collar 114 can include a longitudinal tongue 116 that can be slid into a complementary recess in the adjacent open ends 108 or 110 of the housing 102 to generally align the collar 114 concentrically with the housing 102 and the lumen 112 thereof.

Figure 8:
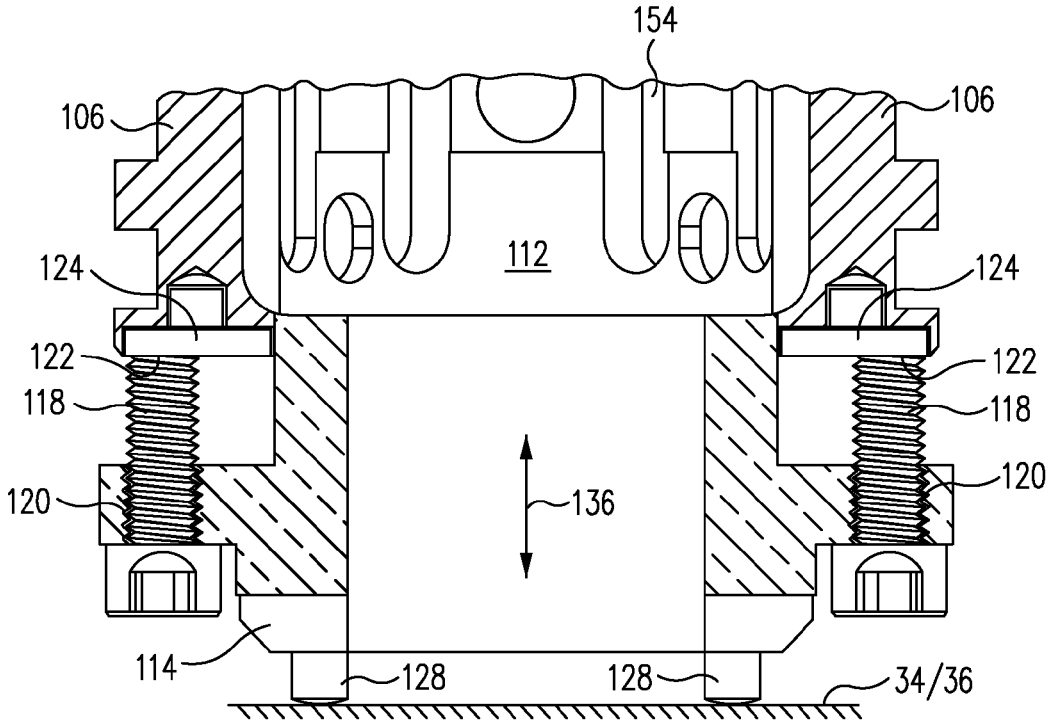
FIG. 8 is a partial cross-sectional view through the expansion collar, screws, and a front end of the first example hand guard, as seen along the lines of the section 8-8 taken in FIG. 2.

As illustrated in, e.g., FIGS. 2, 3 and 8, in one embodiment, the expansion mechanism can comprise a plurality, e.g., two or more, of longitudinally extending screws 118 (e.g., also referred to as jack screws) respectively received in corresponding ones of a plurality of threaded apertures 120 contained in the expansion collar 114. Each screw 118 has a distal end 122 that can be urged into abutment with an adjacent end, 108 or 110 of the lower part 106 of the housing 102. In some embodiments, the end 108 or 110 of the housing 102, against which the distal ends 122 of the screws 118 bear, can be protected against any resultant deformation and wear caused by abutment of the screw ends 122 by the provision of a corresponding plurality of wear pads 124 made of, e.g., a hard metal, disposed in corresponding, complementary recesses 126 in the adjacent end of the lower part 106 of the housing 102. The distal ends 112 of the screws 118 can then respectively bear on the pads 124 with virtually no resulting wear or deformation of the adjacent end of the lower part 106 of the housing. In addition, as screws 118 are tightened, the longitudinal expansion of hand guard 100 may cause protrusions 180 to push against retainer 40 and thus tighten end 110 of hand guard 100 against rifle 10.

Figure 7A:
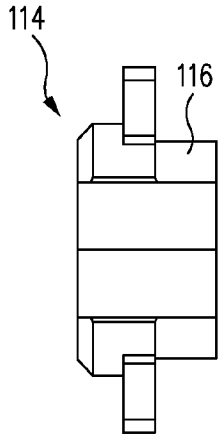
FIG. 7A is a top plan view of the expansion collar part of the first example hand guard.
Figure 7B:
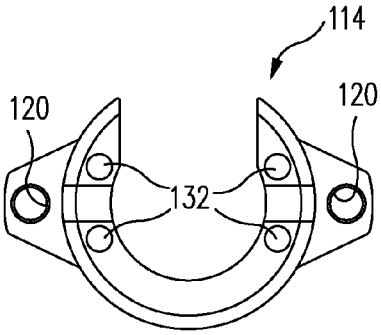
FIG. 7B is a front end elevation view of the expansion collar.
Figure 7C:
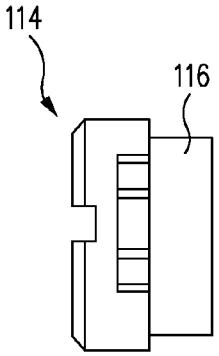
FIG. 7C is a left side elevation view of the expansion collar.
Figure 7D:
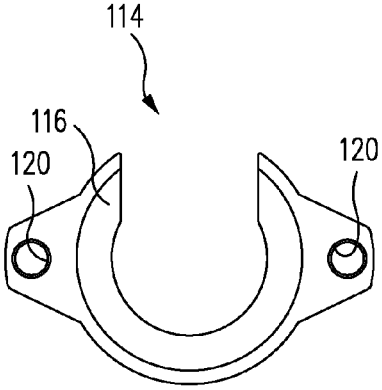
FIG. 7D is a rear end elevation view of the expansion collar.
Figure 7E:
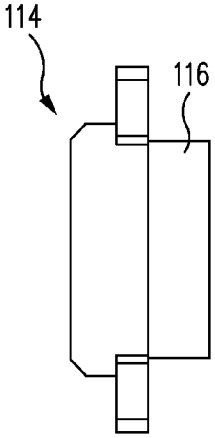
FIG. 7E is a bottom plan view of the expansion collar.
Figure 9:
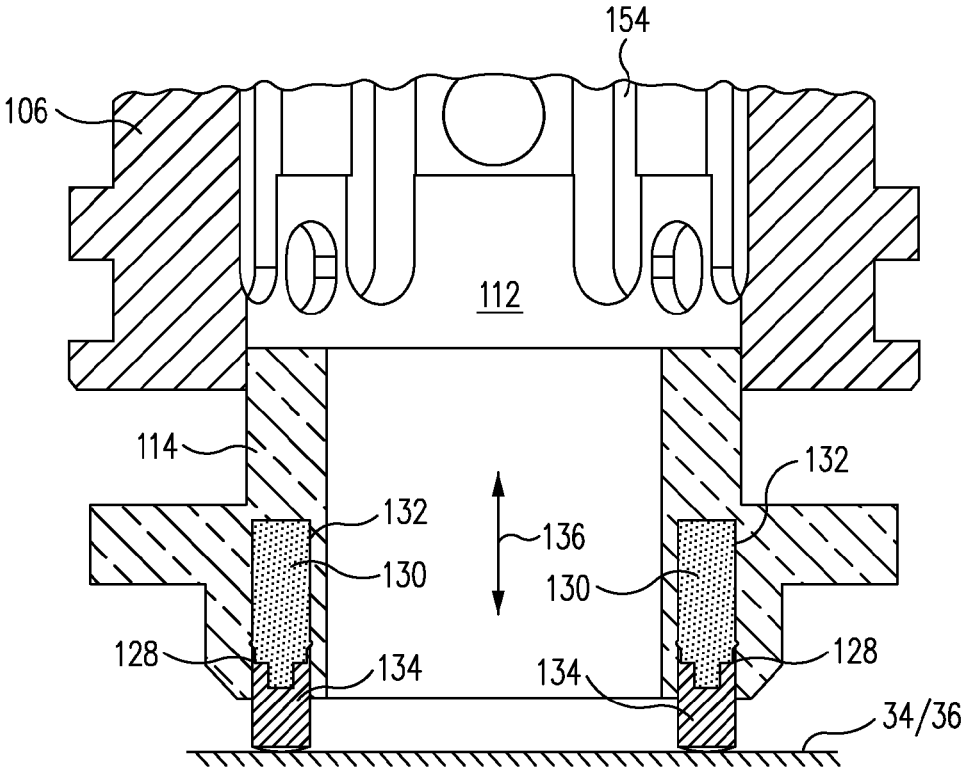
FIG. 9 is a partial cross-sectional view through the expansion collar, compression members, and a front end of the first example hand guard, as seen along the lines of the section 9-9 taken in FIG. 2.

As illustrated in, e.g., FIGS. 3 and 9, in some embodiments, the expansion mechanism can further include a plurality of elongated compression members 128 that extend longitudinally from an end of the expansion collar 114 opposite to the end of the housing 102 at which the expansion collar 114 is disposed. As illustrated in FIG. 9, the compression members 128 can include a first end portion 130 that can comprise a material that may compress and expand (e.g., being at least partially deformable, compressible, and/or expandable) while still remaining relatively resilient, such as rubber or polyurethane, which is disposed in a corresponding bore 132 (see FIG. 7B) in the expansion collar 110, and an opposite second end 134 comprising a relatively harder bearing material, e.g., a metal, such as steel.

In some embodiments, the example hand guard 100 can be mounted on an associated rifle 10 in accordance with the following example mounting method, in which it is assumed that the expansion collar 114 is mounted at the front end 108 of the housing 102 and disposed adjacent to the front radial surface 34, as illustrated in the example embodiment of FIGS. 1A and 1B.

First, the upper part of the housing 102 is removed from the lower part 106, which can be effected in a manner described in more detail below. The longitudinal tongue 116 of the expansion collar 114 is inserted into the front end 108 of the lower part 106 of the housing 102 to form a loose assembly therewith. The assembly of the expansion collar 114 and lower part 106 of the housing 102 is then mounted onto the lower surface of the intermediate portion 32 of the rifle barrel 24 and between the radial surfaces 34 and 36 disposed at the opposite ends thereof, i.e., with the compression members 128 of the expansion collar 114 disposed adjacent to the front radial surface 34 and the rear end 110 of the lower part 106 of the housing 102 disposed adjacent to the rear radial surface 36. In one embodiment, the assembly of the expansion collar 114 and lower part 106 of the housing may be positioned around (e.g., without touching) the intermediate portion 32 of the rifle barrel 24 and rotated thereabout until the lower part 106 of the housing 102 is disposed beneath the rifle barrel 24.

As illustrated in FIG. 8, the screws 118 are then advanced in their respective threaded apertures 120 in the expansion collar 114 such that the distal end 122 of each screw 118 engages a corresponding pad 124 in the adjacent end of the lower part 106 of the housing 102. As indicated by the arrows 136 in FIGS. 8 and 9, further advancement of the screws 118 causes the lower part 102 and expansion collar 114 to spread apart from each other, thereby loading the entire longitudinal assembly comprising the compression members 128, the expansion collar 114, and the lower part 106 of the housing 102, in compression between the two radial surfaces 34 and 36, thereby firmly coupling the longitudinal assembly firmly to the rifle 10.

As those of some skill will appreciate, this compressive force results in a reactive longitudinal tensile force being applied to the barrel 24 of the rifle 10, which, unlike various prior hand guards, does not result in any twisting or local deformations of the barrel 24, and therefore does not adversely affect the accuracy of the rifle 10. Any differences in the respective forces exerted by the screws 118 are taken up by the plurality of compression members 128, which compress or expand locally (e.g., performed by the material of first end portion 130) to ensure that the force exerted by the screws 118 is substantially uniformly distributed among the compression members and on the adjacent end of the lower part 106 of the housing 102. although such compression and expansion is described as being performed by the material of first end portion 130 of compression members 128, such material may be provided by any component of hand guard 100. For example, in one embodiment, such material may be provided as part of screws 118 and/or other components adapted to compress and expand between end 108 and surface 34.

One of the many advantages provided by embodiments of the first example hand guard 100 of the present disclosure is that the upper part 104 of the housing 102 can be removed from the lower part 106 of the housing 102, e.g., to gain access to the gas tube 30 and/or the intermediate portion 32 of the barrel 24, without having to remove the lower part 106 and expansion collar 114 from the rifle 10. As illustrated in, e.g., FIGS. 3 and 6, this can be effected by the provision of a coupling mechanism for releasably coupling the upper part 104 of the housing 102 to the lower part 106 thereof. Moreover, the lower part 106 may remain tightly engaged with surfaces 34 and 36 (e.g., by longitudinal expansion) while the upper part 104 is removed. As a result, accessories installed onto lower part 106 may remain attached and in alignment while the upper part 104 is removed. Also, accessories installed onto upper part 104 may also remain attached and in alignment while the upper part 104 is removed. Therefore, if upper part 104 is subsequently attached to lower part 106, all accessories attached to hand guard 100 may be aligned and ready for use without requiring further adjustment by the user.

In other embodiments, the locations and/or configurations of upper part 104 and/or lower part 106 may be changed. For example, in one embodiment, the locations of upper part 104 and lower part 106 may be reversed such that upper part 104 is actually positioned below lower part 106 while hand guard 100 is installed on intermediate portion 32 of barrel 24. In such an embodiment, upper part 104 may be lowered downward from rifle 10 (e.g., lowered down on the trigger side of rifle 10) while lower part 106 remains installed (e.g., positioned on a top side of rifle 10 and straddling intermediate portion 32 of barrel 24).

Figure 5C:
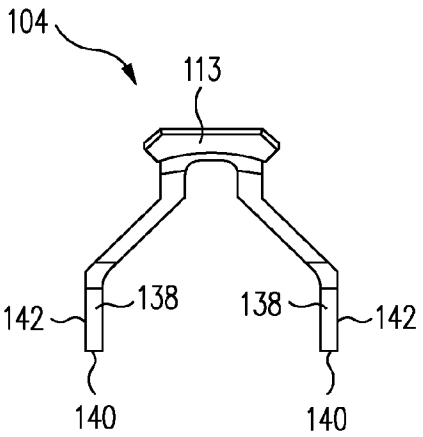
FIG. 5C is a rear end elevation view of the upper part.
Figure 5B:
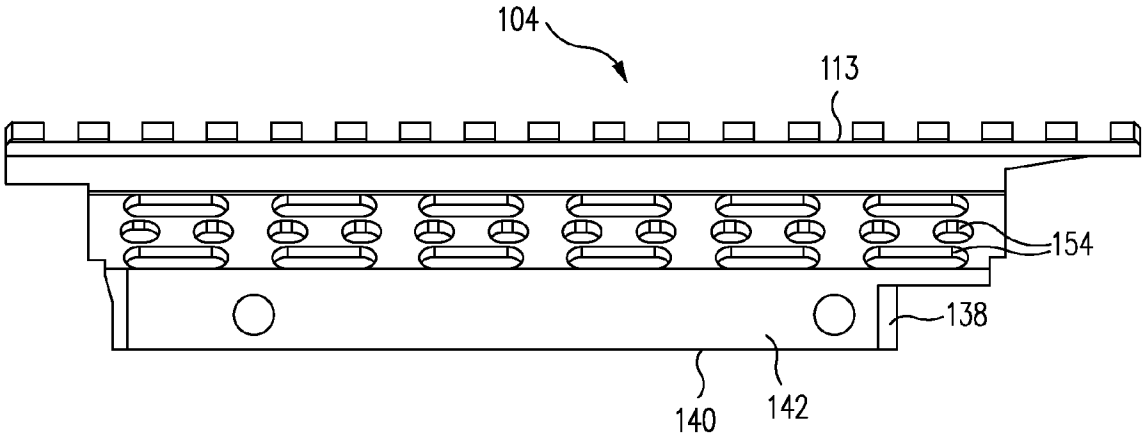
FIG. 5B is a left side elevation view of the upper part.
Figure 5A:
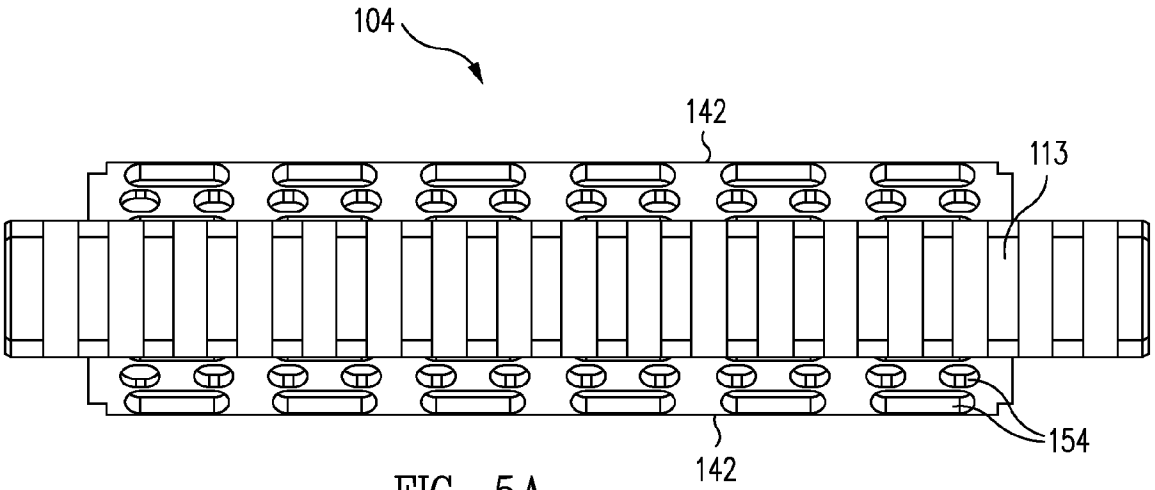
FIG. 5A is a top plan view of the upper part of the first example hand guard.
Figure 5E:
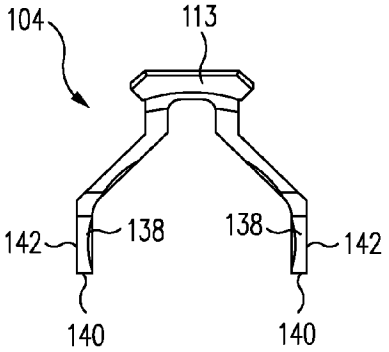
FIG. 5E is a front end elevation view of the upper part.
Figure 5D:
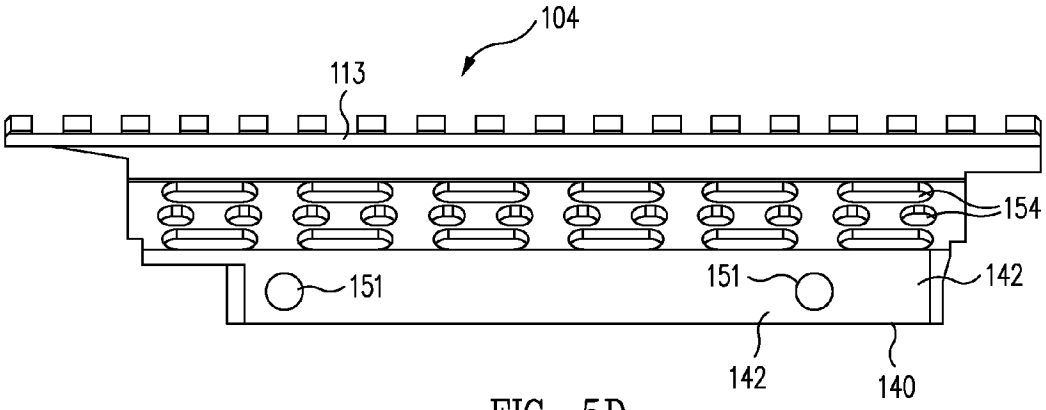
FIG. 5D is a right side elevation view of the upper part.

As illustrated in, e.g., FIGS. 3, 5C, and 5E, the upper part 104 of the housing 102 can include a pair of laterally spaced, downwardly extending side walls 138, each having a lower edge 140 and a generally planar exterior surface 142. As illustrated in, e.g., FIGS. 3 and 6, the lower part 106 of the housing 102 can have a pair of laterally spaced, upwardly extending side walls 141, each of which has a generally planar interior surface 144, with a ledge 146 disposed at a lower edge thereof. As illustrated in FIG. 6, the side walls 138 of the upper part 104 are positionable inside the side walls 141 of the lower part 106 such that respective ones of the planar exterior surfaces 142 of the side walls 138 of the upper part 104 are disposed in facing opposition to corresponding ones of the planar interior surfaces 144 of the side walls 141 of the lower part 102. As illustrated in, e.g., FIGS. 3, 4B, 4D and 6, the coupling mechanism can comprise a plurality of threaded fasteners 148 respectively extending laterally through apertures 150 (e.g., openings) in corresponding ones of the side walls 141 of the lower part 106 of the housing 102 and into corresponding threaded apertures 152 disposed in corresponding ones of the side walls 138 of the upper part 104 of the housing 102, and arranged such that advancement of the fasteners 148 into the threaded apertures 152 acts to pull the planar surfaces 142 of the side walls 138 of the upper part 104 into engagement with corresponding ones of the planar surfaces 144 of the side walls 141 of the lower part 106. In one embodiment, threaded apertures 152 may be provided by side walls 138 of the upper part 104 (e.g., integral therewith). In another embodiment, threaded apertures 152 may be provided by separate components 153 (e.g., nuts or bushings) that are pressed, welded, and/or otherwise attached positioned into apertures 151 of the upper part 104 (e.g., positioned within lumen 112 when hand guard 100 is assembled).

Additionally, in some embodiments, the threaded apertures 152 in the side walls 138 of the upper part 104 can be respectively disposed a first distance above the lower edge 140 of the corresponding side wall 138 of the upper part 104, and the apertures 150 in the side walls 141 of the lower part 106 can be respectively disposed a second distance above the ledge 146 of the corresponding side wall 141. The first distance can be made slightly greater than the second distance (e.g., greater by a distance of approximately 8 thousandths of an inch in one embodiment), such that advancement of the threaded fasteners 148 into the threaded apertures 152 further acts to pull the lower edges 140 of the side walls 138 of the upper part 104 into a tight engagement with the corresponding ledges 146 of the side walls 141 of the lower part 106, thus ensuring a tight coupling of the upper part 104 to the lower part 106.

In some embodiments, as shown in FIG. 3, apertures 150 may be implemented with countersinks 155. In one embodiment, countersinks 155 may be offset downward or otherwise (e.g., by approximately 8 thousandths of an inch in one embodiment) such that upper portions of heads 149 of threaded fasteners 148 contact rail 113 and/or the lower part 106 before threaded fasteners 148 are fully screwed into threaded apertures 152 and fully seated within countersinks 155. Such contact can provide compressive force to further secure upper part 104 and lower part 106 together.

As illustrated in, e.g., FIGS. 2 and 3, selected ones or all of the side walls of the housing 102 can include a pattern of vent holes 154 extending therethrough. The vent holes 154 serve to reduce the weight of the hand guard substantially, and can also serve both to cool the barrel 24 of the rifle 10 during extended firing thereof, thereby ensuring that the hand guard 100 remains cool to the touch, and also to mount certain types of accessories to the hand guard 100 (e.g., such as lighting device 190 in one embodiment). In various embodiments, accessories may be mounted directly to vent holes 154 (e.g., without requiring rail clamp 192 or other mounting mechanisms).

Figure 10:
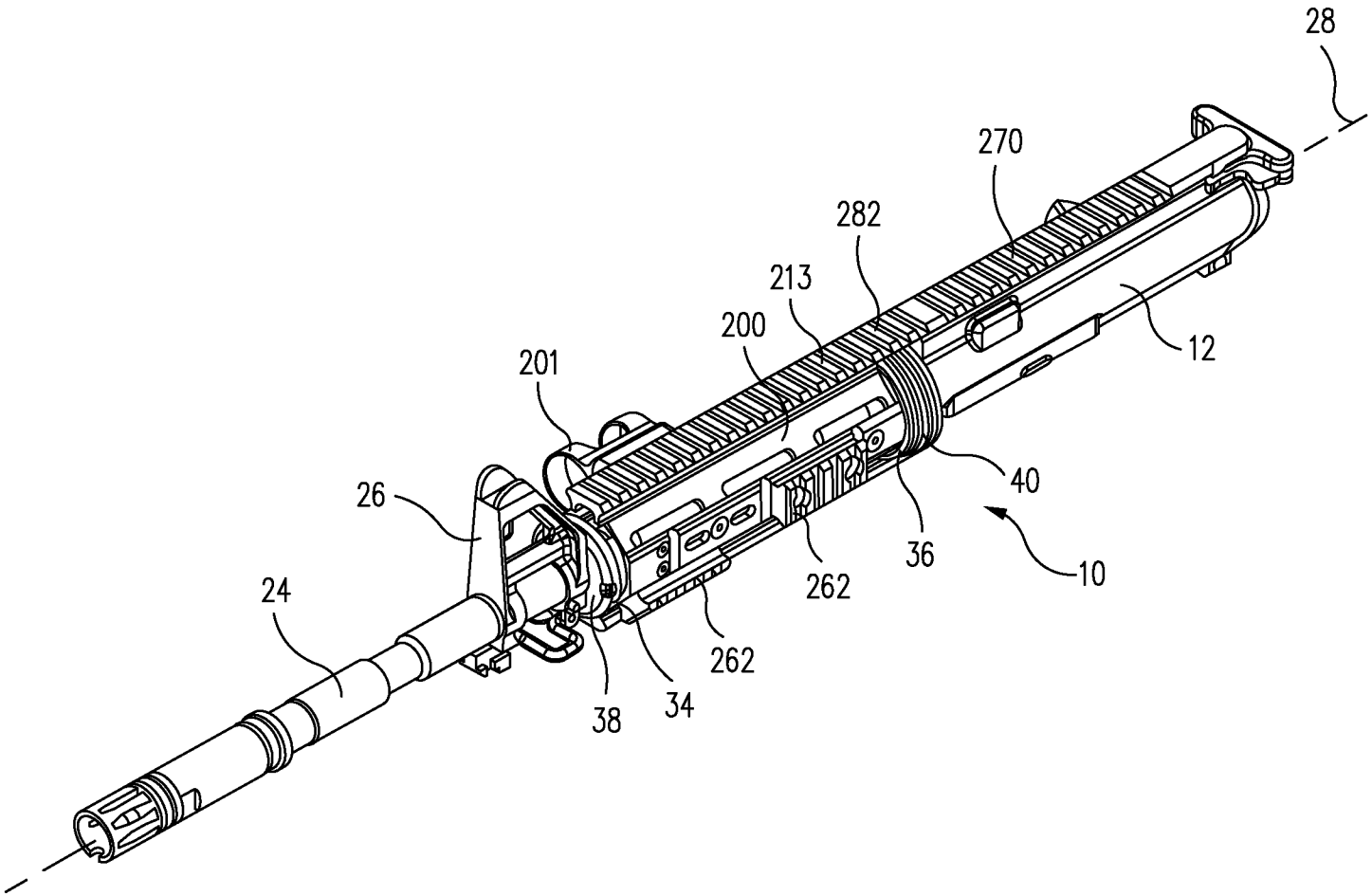
FIG. 10 is an upper left side perspective view of a receiver and barrel of an M4 rifle, showing a second example embodiment of a hand guard in accordance with the present disclosure mounted thereon.
Figure 11:
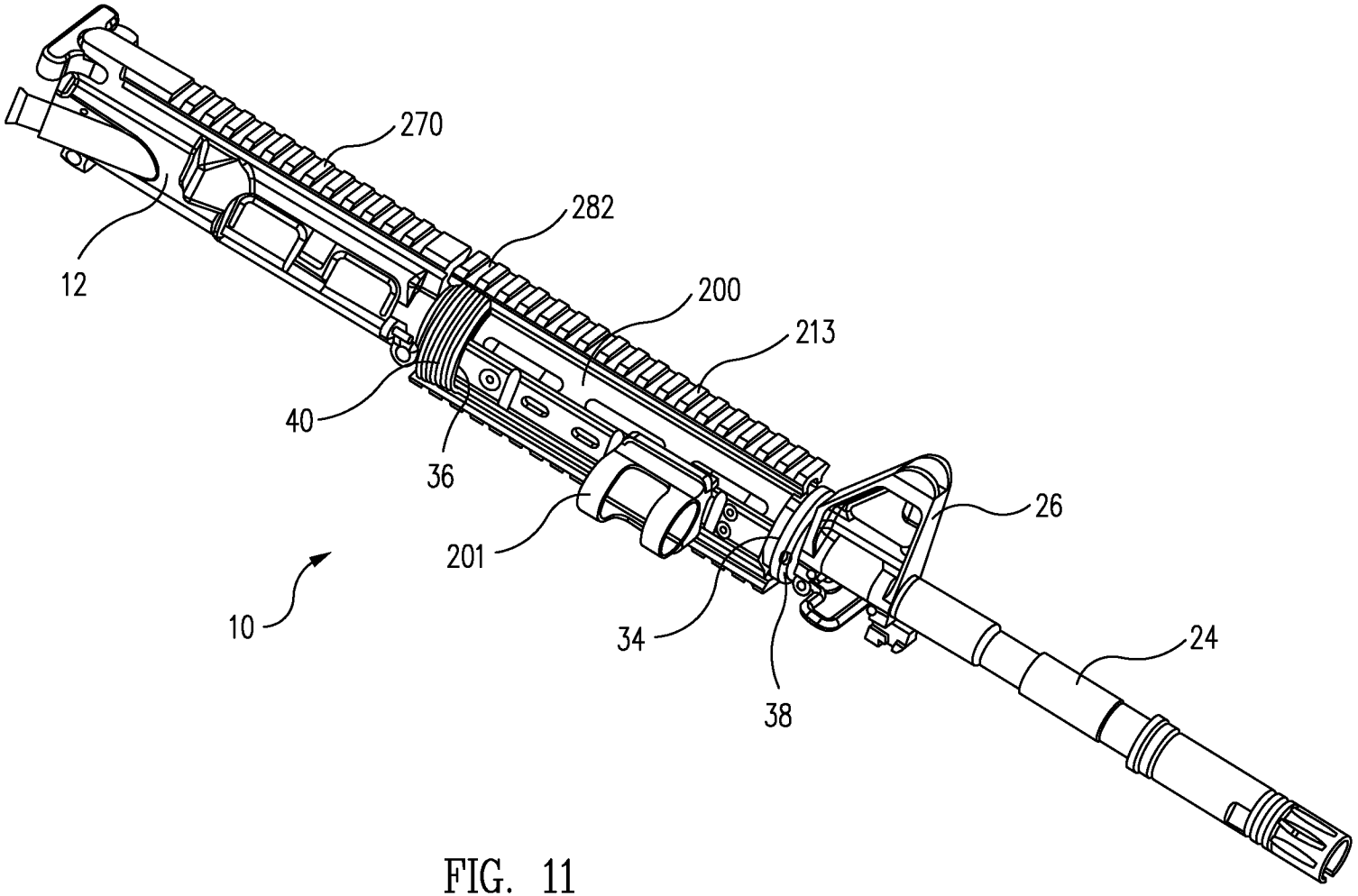
FIG. 11 is an upper, front, right side perspective view of the receiver, barrel and second example hand guard of FIG. 10, showing an example accessory mounting bracket mounted thereon.

FIG. 10 is an upper left side perspective view of a receiver and barrel of an M4 rifle 10 (e.g., with rear sight 14 removed), showing a second example embodiment of a hand guard 200 in accordance with the present disclosure mounted thereon, and FIG. 11 is an upper, front, right side perspective view of the receiver, barrel and second example hand guard 200 of FIG. 10, showing an example accessory mounting bracket 201 mounted on the right side thereof.

As can be seen from a comparison of the figures respectively illustrating the first and second example hand guards 100 and 200, the two example hand guards 100 and 200 differ in various ways such as, for example, the mechanisms used to spread the lower part of the hand guard and expansion collar apart from each other so as load the assembly of the expansion collar and the lower part of the housing of the hand guard in compression between the two radial surfaces 34 and 36 of the rifle 10, coupling mechanisms and engagement surfaces, features in the side walls of the hand guard housing that enable various accessory mounting brackets to be coupled to it efficiently and reliably, and other features further discussed herein.

Figure 12:
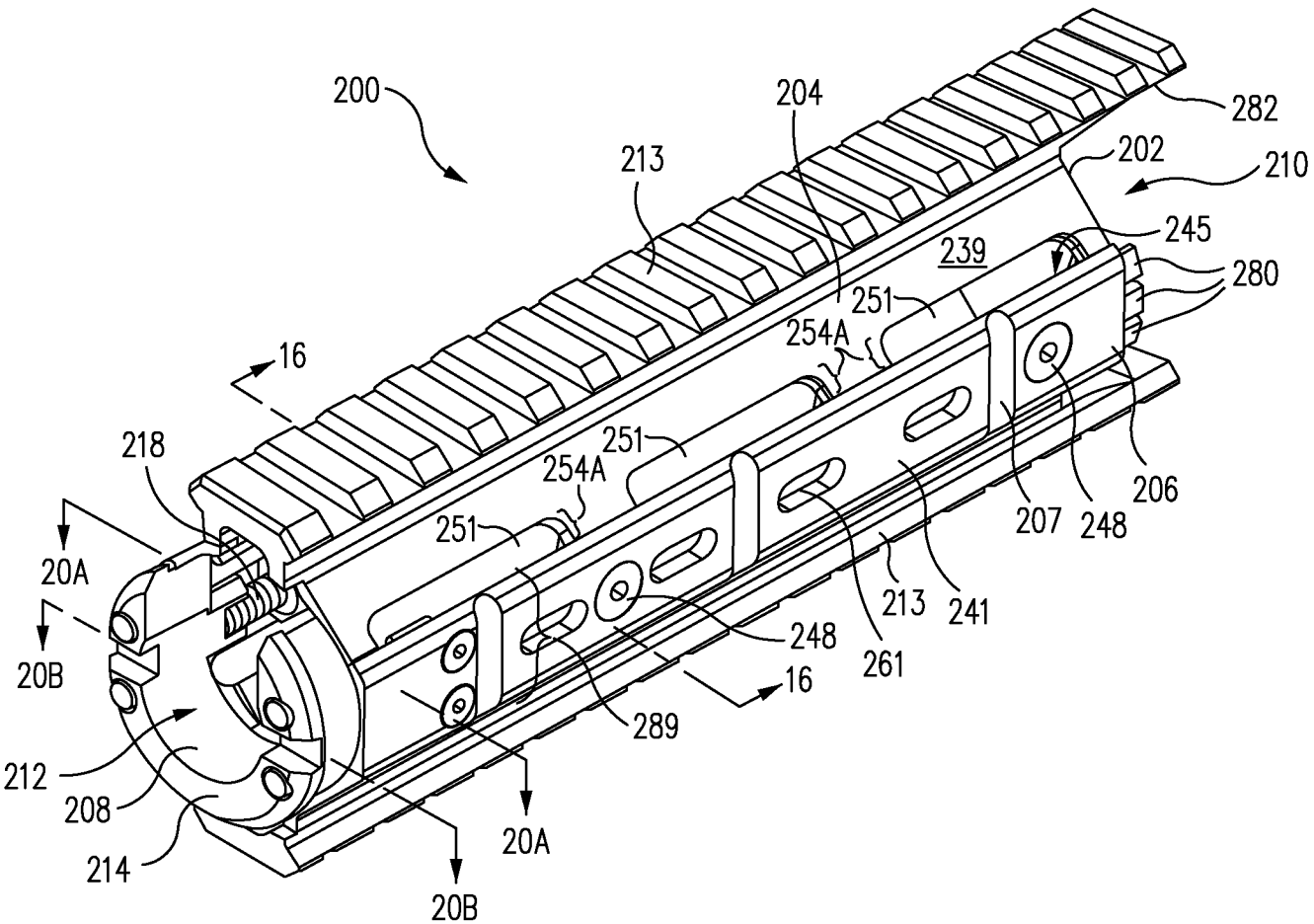
FIG. 12 is an upper, front, left side perspective view of the second example hand guard of FIGS. 10 and 11.
Figure 13:
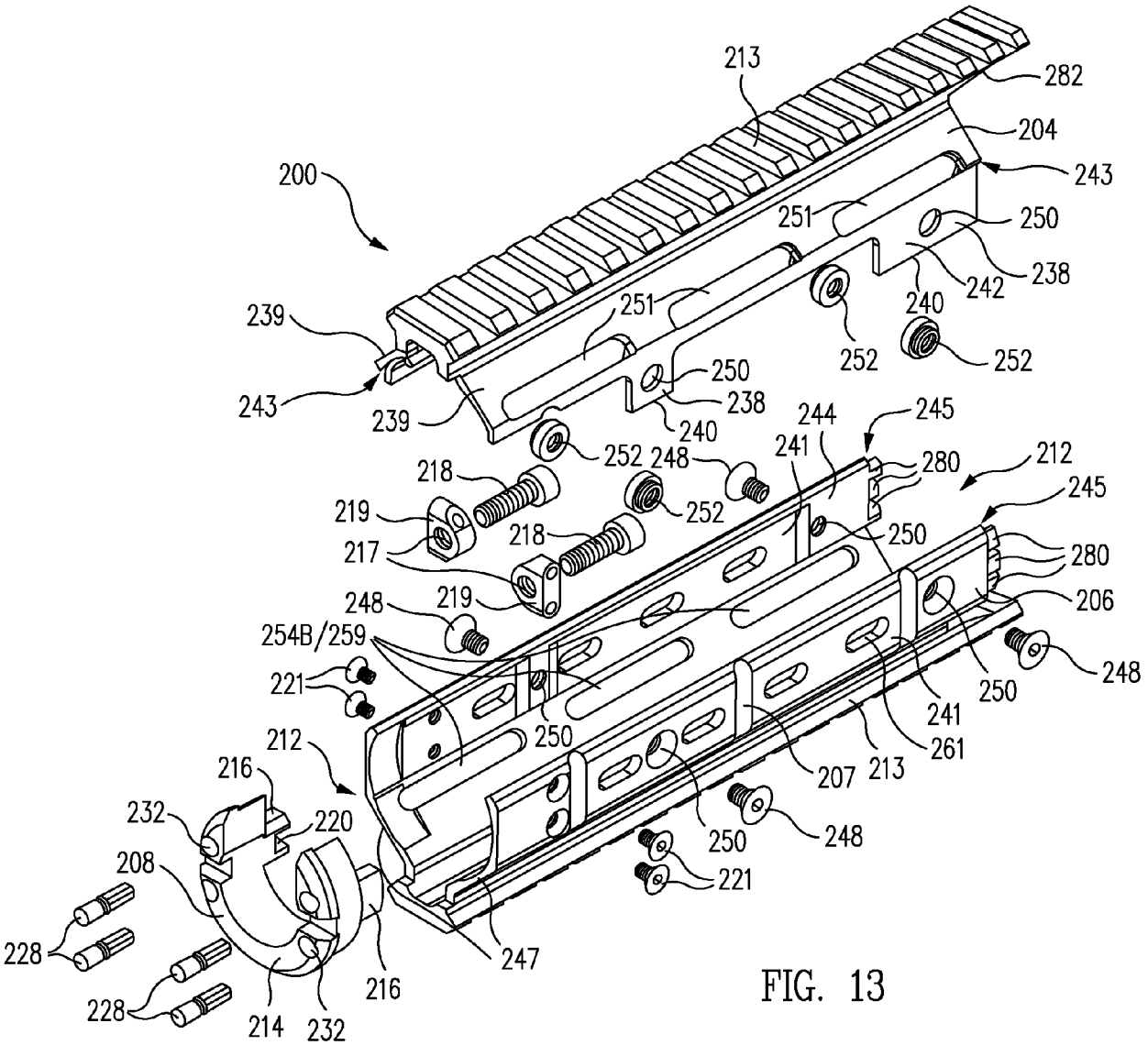
FIG. 13 is an upper, front, left side exploded perspective view of the second example hand guard, showing an upper part, a lower part, and an expansion collar thereof.

FIGS. 12 and 13 are upper, front, left side perspective and exploded perspective views of the second example hand guard 200, respectively. As illustrated in FIGS. 12 and 13, the second example hand guard 200 can, like the first example embodiment 100 above, comprise an elongated tubular housing 202 having an upper part 204, a lower part 206, opposite open ends 208 and 210, and a longitudinal lumen 212 configured to accommodate the gas tube 30 and intermediate portion 32 of the barrel 24 of the rifle 10 longitudinally therein.

As illustrated in the cross-sectional view of the housing 202 in FIGS. 16 and 19A-19C, the housing 202 can have a generally polygonal cross-section, and in the particular embodiment illustrated, the housing 202 has eight side walls, i.e., has a cross-sectional shape that is octagonal. Of course, other cross-sectional shapes, including round or annular, can also be used. At least one of the side walls of the housing 202 can comprise an integrally formed, longitudinal accessory mounting rail 213, such as specified in MIL-STD-1913 and commonly referred to as a "Picatinny" rail, or as discussed below, a variation thereof. In the particular example embodiment illustrated in FIGS. 16 and 19A-19C, two such integral accessory mounting rails 213 are provided, i.e., one disposed atop the top wall of the upper part 204 of the housing 202, and one disposed on the bottom wall of the lower part 206 thereof.

As illustrated in FIGS. 10 and 11, when the second example hand guard 200 is installed on the receiver 12 of the rifle 10, a top rail 213 on the upper part 204 can be disposed substantially level with another rail 270 (e.g., another longitudinal accessory mounting rail, such as another Picatinny rail or other type of rail). Such positioning of the rails 213 and 270 can advantageously enable various accessories to be mounted substantially in line with each other on the rails 213 and 270 and/or enable such accessories to be mounted across both rails 213 and 270 (e.g., using the mounting locations of both rails 213 and 270). As discussed above in connection with the first example embodiment 100, one or more accessories can be mounted on the rails 213 such as, for example, lighting devices, sighting devices, and/or other types of devices.

In some embodiments, the upper part 204 can include one or more protrusions 282 (e.g., one or more flanges or individual protruding members) configured to engage or overlie a front end portion of the receiver 12 (see, e.g., FIGS. 10-12). For example, the protrusion 282 can extend over, rest upon, and/or push against various external portions of the retainer 40. In some embodiments, the lower part 206 can include one or more protrusions 280 (e.g., implemented as one or more flanges or individual protruding fingers) configured to engage or contact the retainer (e.g., barrel nut) 40 (see, e.g., FIGS. 12 and 13). For example, the protrusions 280 can rest upon and/or push against the retainer 40. In various embodiments, the protrusions 280 and/or the flanged portion 282 can be used to further secure the hand guard 200 to the rifle 10.

As illustrated in, e.g., FIGS. 12, 13, 17A-17E, 20A and 20B, the second example hand guard 200 also comprises an expansion collar 214 disposed at one end of the housing 202. The expansion collar 214 incorporates an expansion mechanism, described in more detail below, that is configured to adjustably compress the expansion collar 214 and the lower part 206 of the housing 202 longitudinally between the radial surfaces 34 and 36 located at opposite ends of the intermediate portion 32 of the barrel 24, as described above. In the particular embodiment illustrated in the figures, the expansion collar 214 is shown disposed adjacent to the front end 208 of the housing 202, but as those of some skill in this art will appreciate, this arrangement can be reversed, such that the expansion collar 214 is disposed adjacent to the rear end 210 of the housing 202.

Additionally, as illustrated in, e.g., FIGS. 13 and 17A-17E, the expansion collar 214 can include a pair of longitudinal tongues 216 that can be slid into a complementary recess in the adjacent open ends 208 or 210 of the housing 202 to generally align the collar 214 concentrically with the housing 202 and the lumen 212 thereof.

Figure 20A:
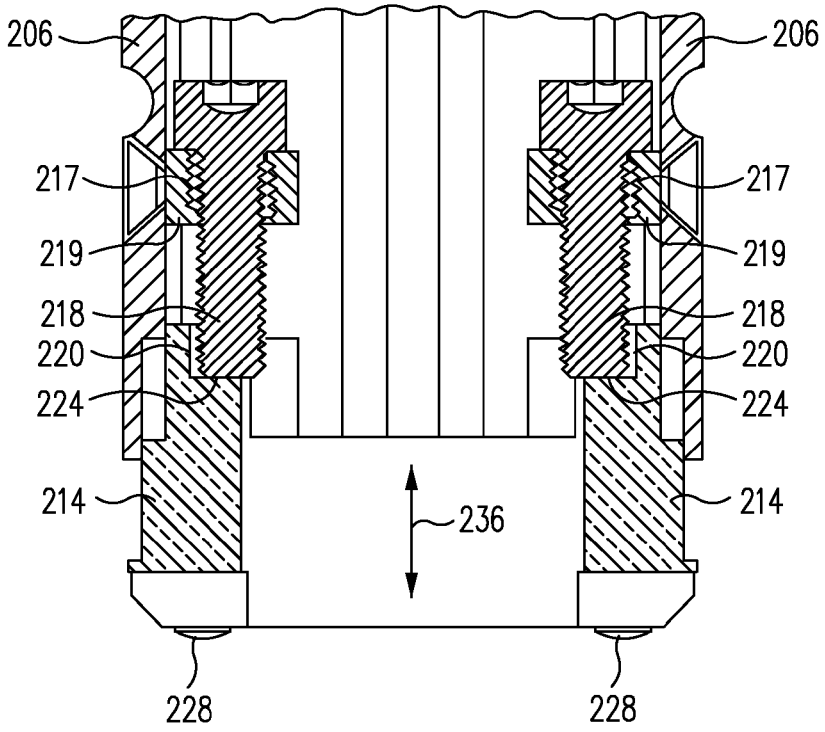
FIG. 20A is a partial cross-sectional view through the expansion collar, jack screws, and a front end of the second example hand guard, as seen along the lines of the section 20A-20A taken in FIG. 12.

As illustrated in, e.g., FIGS. 13 and 20A, in one embodiment, the expansion mechanism can comprise a pair of longitudinally extending screws 218 (also referred to herein as jack screws) respectively received in corresponding ones of a pair of threaded apertures 217 respectively contained in a corresponding pair of laterally opposing stanchions 219 respectively attached to the inner surfaces of the side walls 241 of the lower part 206. In the particular example embodiment illustrated in the figures, each of the two side wall stanchions 219 is attached to a corresponding side wall 241 of the lower part 206 by a pair of threaded fasteners 221 that extend through corresponding through-apertures in the adjacent side wall 241 and into corresponding threaded apertures in the stanchions 219. However, as those of some skill will understand, the stanchions 219 can be coupled or connected to the side walls 241 of the lower part 206 using other methods, such as brazing, welding, staking, riveting, adhesive bonding and so on.

Figure 17A:
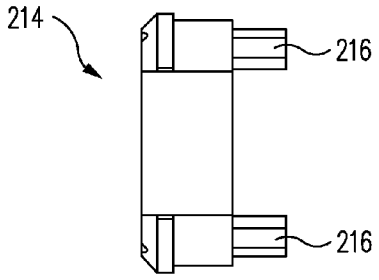
FIG. 17A is a top plan view of the expansion collar of the second example hand guard.
Figure 17B:
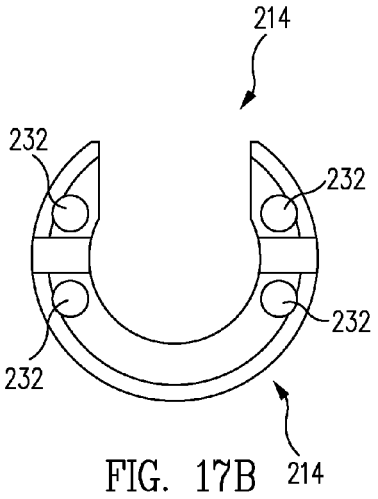
FIG. 17B is a front end elevation view of the expansion collar.
Figure 17C:
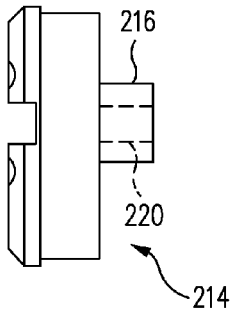
FIG. 17C is a left side elevation view of the expansion collar.
Figure 17D:
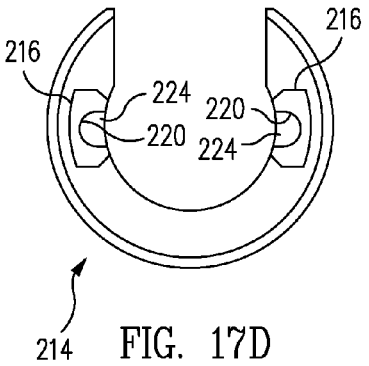
FIG. 17D is a rear end elevation view of the expansion collar.
Figure 17E:
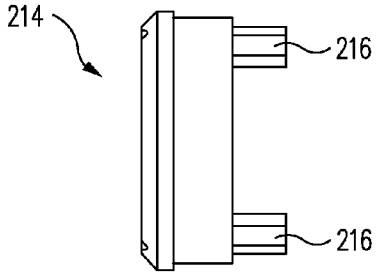
FIG. 17E is a bottom plan view of the expansion collar.

As illustrated in FIGS. 17D and 20A, each of the longitudinal tongues 216 of the expansion collar 214 includes a longitudinal bore 220 having an open side and a bottom end surface 224. Each jack screw 218 has a distal end that can be urged into abutment with an corresponding one of the bottom end surfaces 224 of the longitudinal bores 220 by advancing the jack screw 218 in the threaded aperture 217 of the corresponding stanchion 219. Thus, as the screws 218 are advanced within the threaded apertures 217 of the stanchions 219 (e.g., in an opposite direction as screws 118 of hand guard 100), the resulting longitudinal expansion of the hand guard 200 causes the protrusions 280 to push against the retainer 40 and thereby tighten the end 210 of the hand guard 200 against the forward facing surface 36 of the receiver 12 of the rifle 10.

Figure 20B:
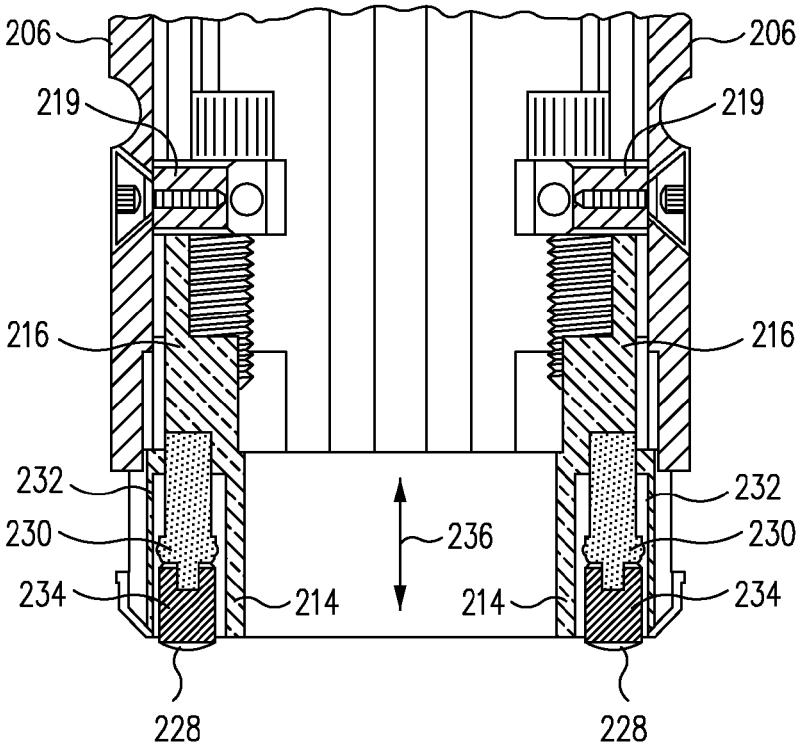
FIG. 20B is a partial cross-sectional view through the expansion collar, compression members, and the front end of the second example hand guard, as seen along the lines of the section 20B-20B taken in FIG. 12.

As illustrated in, e.g., FIGS. 13 and 20B, in some embodiments, the expansion mechanism can further include a plurality of elongated compression members 228 that extend longitudinally from an end of the expansion collar 214 opposite to the end of the housing 202 at which the expansion collar 214 is disposed. As illustrated in FIG. 20B, the compression members 228 can include a first end portion 230 that can comprise a material that can compress and expand (e.g., being at least partially deformable, compressible, and/or expandable) while still remaining relatively resilient, such as a rubber or polyurethane, which is disposed in a corresponding bore 232 (see, e.g., FIG. 17B) in the expansion collar 214, and an opposite second end 234 that can comprise a relatively harder bearing material, e.g., a metal, such as steel or aluminum.

In some embodiments, the second example hand guard 200 can be mounted on an associated rifle 10 in accordance with the following example mounting method, in which it is assumed that the expansion collar 214 is mounted at the front end 208 of the housing 202 and disposed adjacent to the front radial surface 34 of the rifle 10, as illustrated in the example embodiment of FIGS. 10 and 11. However, as discussed above, this orientation can be reversed, if desired.

First, the upper part 204 of the housing 202 is removed from the lower part 206, which can be effected in a manner described in more detail below. The longitudinal tongues 216 of the expansion collar 214 are inserted into the front end 208 of the lower part 206 of the housing 202 to form a loose assembly therewith. The assembly of the expansion collar 214 and lower part 206 of the housing 202 is then mounted onto the lower surface of the intermediate portion 32 of the rifle barrel 24 and between the radial surfaces 34 and 36 disposed at the opposite ends thereof, i.e., with the compression members 228 of the expansion collar 214 disposed adjacent to the rear-facing front surface 34 and the rear end 210 of the lower part 206 of the housing 202 disposed adjacent to the front-facing rear surface 36. In one embodiment, the assembly of the expansion collar 214 and lower part 206 of the housing 202 can be positioned around (e.g., without touching) the intermediate portion 32 of the rifle barrel 24 and rotated thereabout until the lower part 206 of the housing 202 is disposed below the rifle barrel 24.

As illustrated in FIGS. 20A and 20B, the screws 218 are then advanced in their respective threaded apertures 217 in the stanchions 219 such that the distal end of each screw 218 is disposed in abutment with corresponding one of the bottom end surfaces 224 of the longitudinal bores 220 in the tongues 216 of the expansion collar 214. As indicated by the arrows 236 in FIGS. 20A and 20B, further advancement of the screws 218 causes the lower part 206 and the expansion collar 214 to spread apart from each other longitudinally, thereby loading the entire longitudinal assembly comprising the compression members 228, the expansion collar 214, and the lower part 206 of the housing 202, in compression between the two radial surfaces 34 and 36, thereby firmly coupling the longitudinal assembly firmly to the rifle 10.

As those of some skill will appreciate, this compressive force results in a reactive longitudinal tensile force being applied to the barrel 24 of the rifle 10, which, unlike various prior hand guards, does not result in any twisting or local deformations of the rifle barrel 24, and therefore, does not adversely affect the accuracy of the rifle 10. Any differences in the respective forces exerted by the screws 218 are taken up by the plurality of compression members 228, which compress or expand locally (e.g., effected by the resilient material of first end portion 230) to ensure that the force exerted by the screws 218 is substantially uniformly distributed among the compression members 228 and on the adjacent end of the bottom part 206 of the housing 202. Although such compression and expansion is described as being effected by the material of the first end portions 230 of compression members 228, such operation can also be provided by any component of the hand guard 200. For example, in one embodiment, this function may be effected by, for example, a spring comprising a part of the jack screws 218 and/or other components adapted to compress and expand between the end 208 of the lower part 206 of the housing 202 and the rear-facing radial surface 34.

One of the many advantages provided by the embodiments of the hand guard 100 and 200 of the present disclosure is that the upper part 104 or 204 of the housing 102 or 202 can be removed from the lower part 106 or 206 of the housing 102 or 202, e.g., to gain access to the gas tube 30 and/or the intermediate portion 32 of the barrel 24, without having to remove the lower part 106 or 206 and the expansion collar 114 or 214 from the rifle 10. As illustrated in, e.g., FIGS. 13 and 16, this can be effected in the case of the second example hand guard 200 by the provision of a coupling mechanism for releasably coupling the upper part 204 of the housing 202 to the lower part 206 thereof. Moreover, the lower part 206 can remain tightly engaged with surfaces 34 and 36 (e.g., by longitudinal expansion) while the upper part 204 is removed. As a result, accessories installed on the lower part 206 can remain attached and in alignment with the rifle 10 while the upper part 204 is removed. Also, any accessories installed onto the upper part 204 can also remain attached and in alignment with the upper part 204 when the upper part 204 is removed. Thus, if the upper part 204 is subsequently re-attached to the lower part 206, all accessories attached to the hand guard 200, whether mounted on the upper part 204 or the lower part 206 will remain aligned and ready for use without requiring further adjustment by the user.

In other embodiments, the locations and/or configurations of the upper part 204 and/or lower part 206 can be changed. For example, in one embodiment, the locations of the upper part 204 and lower part 206 can be reversed such that upper part 204 is actually positioned below the lower part 206 while hand guard 200 is installed on intermediate portion 32 of barrel 24. In such an embodiment, the upper part 204 can be lowered downward from rifle 10 (e.g., lowered down to the trigger side of rifle 10) while lower part 206 remains installed (e.g., positioned on a top side of the rifle 10 and straddling the intermediate portion 32 of the barrel 24). Indeed, in this embodiment (and applicable to hand guard 100 and 200), it is possible to omit the upper part 104/204 entirely and install, for example, a grenade launcher or other component in its place below the barrel 24 of the rifle 10. In other embodiments, upper part 104/204 may be omitted while lower part 106/206 is positioned on a bottom side of the rifle 10 (e.g., to permit installation of any desired apparatus in place of upper part 104/204 above barrel 24). In any case, omission of upper part 104/204 may also permit the user to gain access to barrel 24, gas tube 30 (e.g., in some embodiments, gas tube 30 may not be accessible while upper part 104/204 is removed), and/or other portions of rifle 10 while lower part 106/206 remains installed in a position on a bottom side or top side of rifle 10.

Figure 14A:
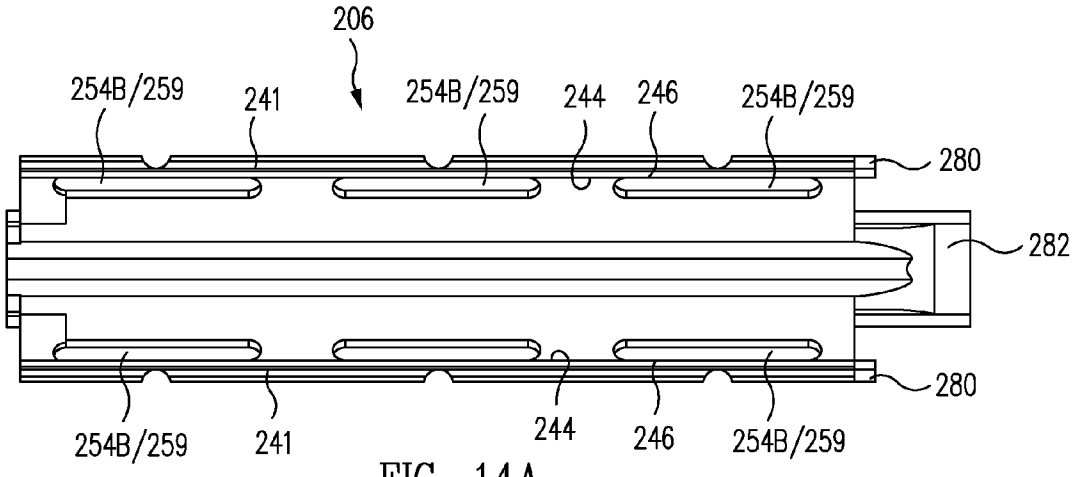
FIG. 14A is top plan view of the lower part of the second example hand guard.
Figure 14B:
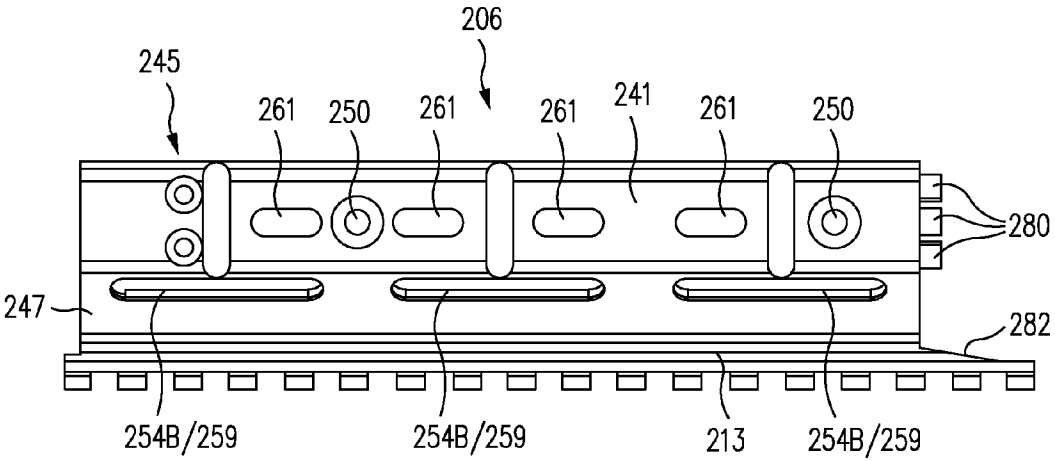
FIG. 14B is a left side elevation view of the lower part.
Figure 14C:
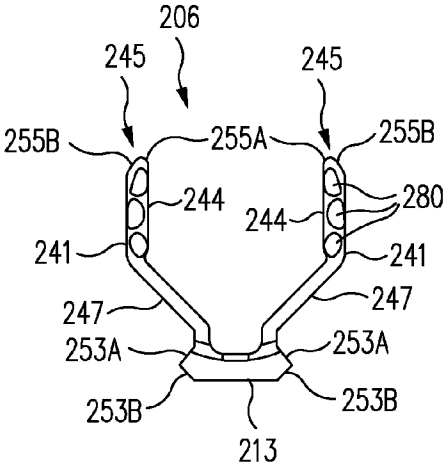
FIG. 14C is a rear end elevation view of the lower part.
Figure 14E:
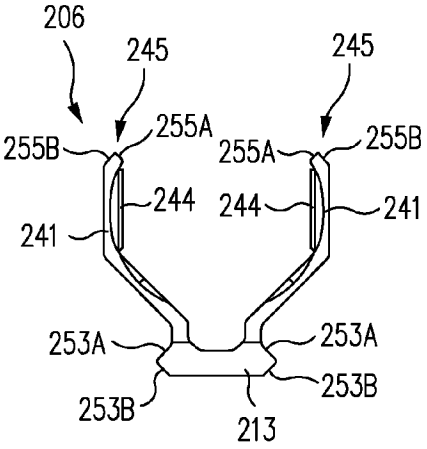
FIG. 14E is a front end elevation view of the lower part.
Figure 14D:
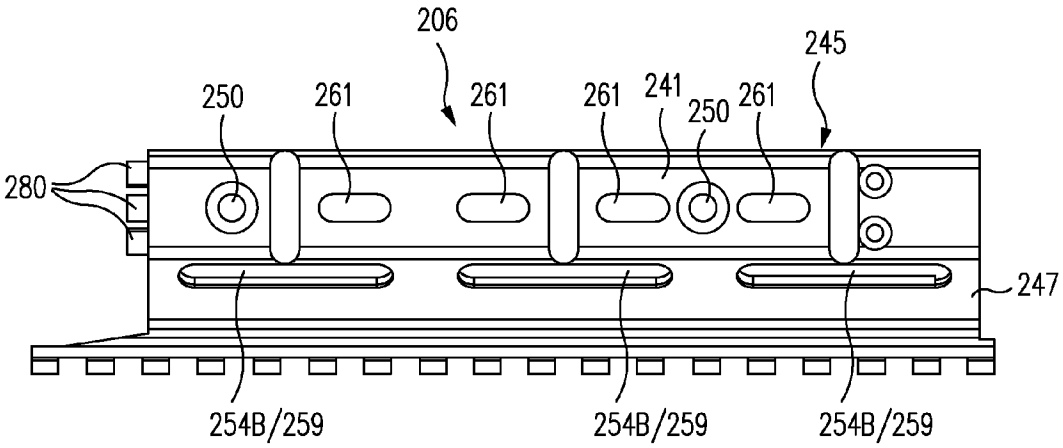
FIG. 14D is a right side elevation view of the lower part.
Figure 14F:
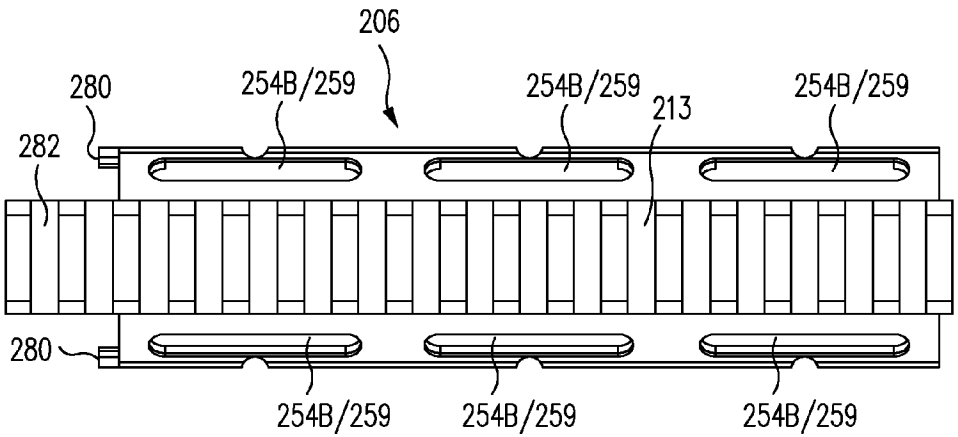
FIG. 14F is a bottom plan view of the lower part.
Figure 15A:
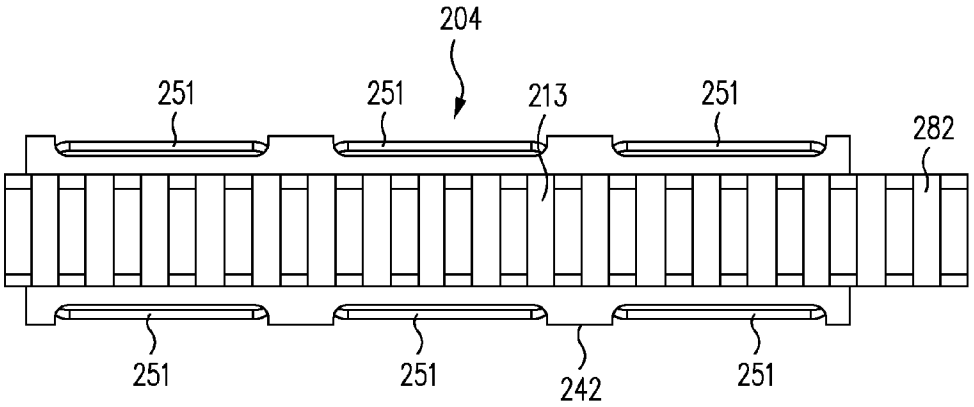
FIG. 15A is a top plan view of the upper part of the second example hand guard.
Figure 15B:
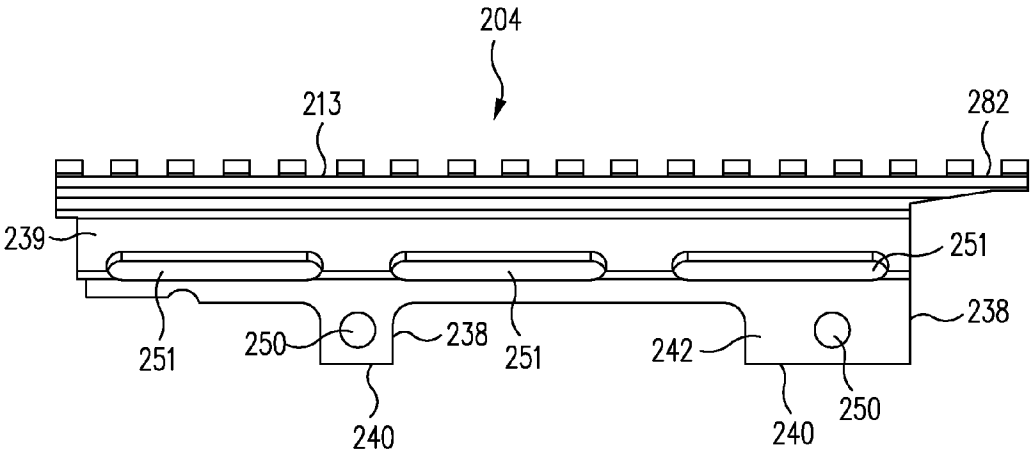
FIG. 15B is a left side elevation view of the upper part.
Figure 15C:
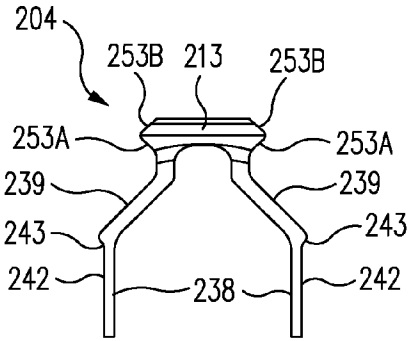
FIG. 15C is a rear end elevation view of the upper part.
Figure 15E:
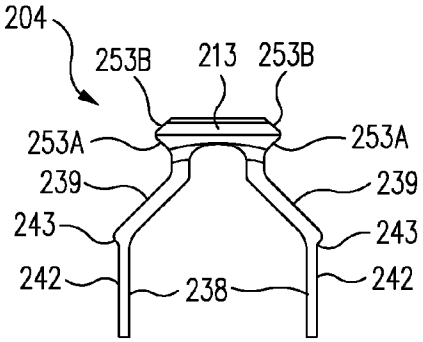
FIG. 15E is a front end elevation view of the upper part.
Figure 16:
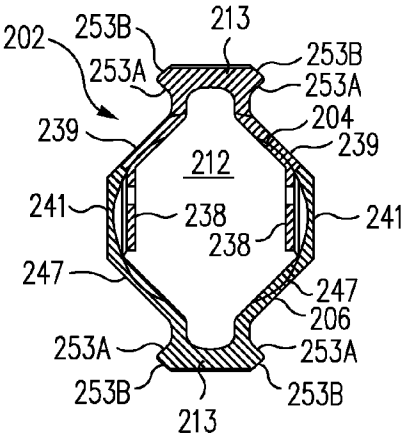
FIG. 16 is a cross-sectional view through the second example hand guard, as seen along the lines of the section 16-16 taken in FIG. 12.
Figure 15D:
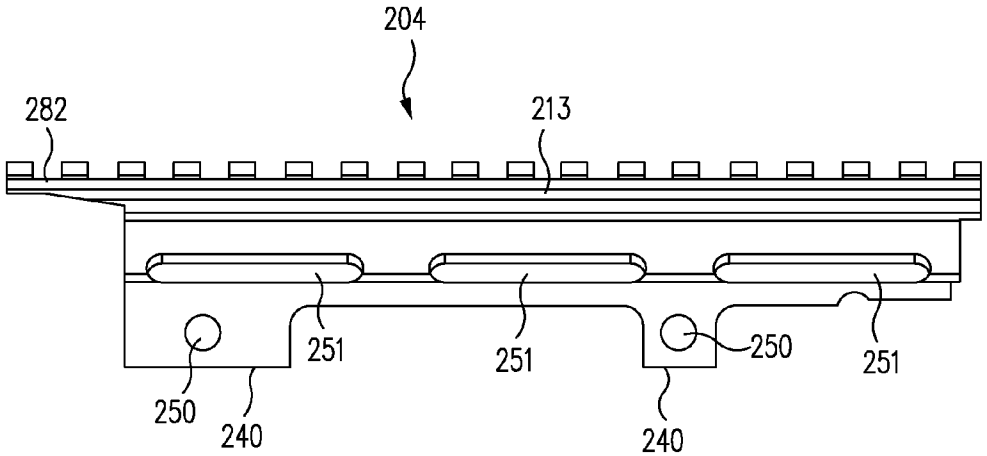
FIG. 15D is a right side elevation view of the upper part.
Figure 15F:
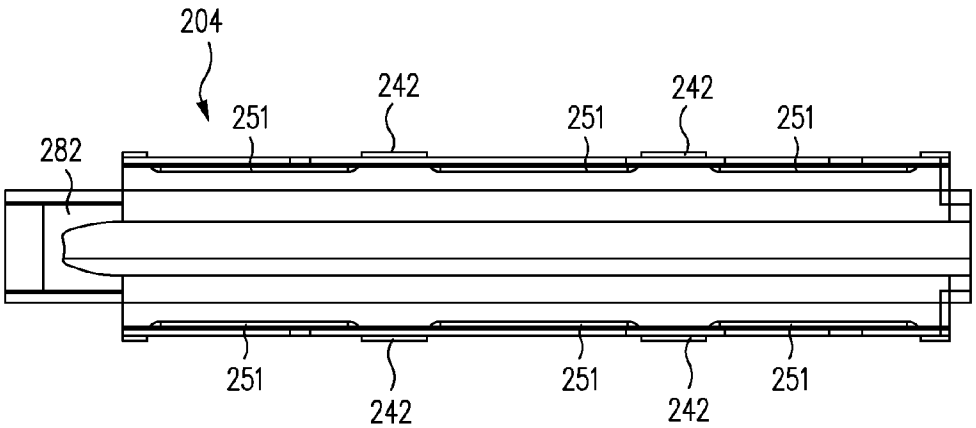
FIG. 15F is a lower plan view of the upper part.

As illustrated in, e.g., FIGS. 13, 15B, 15C, and 15E, the upper part 204 of the housing 202 can include a pair of laterally spaced, downwardly extending lateral side walls 238, and inclined side walls 239 (e.g., inclined approximately 45 degrees relative to side walls 238). Each of side walls 238 include a generally planar exterior surface 242 and a flange 243 (e.g., a downwardly projecting engagement surface extending over lateral side walls 238). As illustrated in, e.g., FIGS. 13, 14C, and 16, the lower part 206 of the housing 202 can have a pair of laterally spaced, upwardly extending lateral side walls 241, and inclined side walls 247 (e.g., inclined approximately 45 degrees relative to side walls 241). Each of side walls 241 has a generally planar interior surface 244 and also an upper edge 245 (e.g., an upwardly projecting engagement surface at the intersection of angulated faces 255A-B). As illustrated in FIGS. 16 and 19A-19C, the side walls 238 of the upper part 204 are positionable inside the side walls 241 of the lower part 206 such that respective ones of the planar exterior surfaces 242 of the side walls 238 of the upper part 204 are disposed in facing opposition to corresponding ones of the planar interior surfaces 244 of the side walls 241 of the lower part 206. Moreover, flange 243 of upper part 204 may be brought into contact with upper edge 245 of lower part 206.

As illustrated in, e.g., FIGS. 12 and 13, the coupling mechanism can comprise a plurality of threaded fasteners 248 respectively extending laterally through apertures 250 in corresponding ones of the side walls 241 of the lower part 206 of the housing 202 and into corresponding threaded apertures 252 disposed in corresponding ones of the side walls 238 of the upper part 204 of the housing 202, and arranged such that advancement of the fasteners 248 into the threaded apertures 252 acts to pull the planar surfaces 242 of the side walls 238 of the upper part 204 into engagement with corresponding ones of the planar surfaces 244 of the side walls 241 of the lower part 206. In one embodiment, the threaded apertures 152 can be provided in the side walls 238 of the upper part 204 (e.g., integral therewith). In another embodiment, the threaded apertures 252 can be provided by separate components (e.g., nuts or bushings) that are pressed, welded, and/or otherwise attached positioned into corresponding apertures in the upper part 204 (e.g., positioned within the lumen 212 when the hand guard 200 is assembled).

Additionally, in some embodiments, the threaded apertures 252 in the side walls 238 of the upper part 204 can be disposed such that they are slightly higher (e.g., offset by a distance of 8 thousandths of an inch in one embodiment) than the apertures 250 in the side walls 241 of the lower part 206 when upper part 204 is inserted into lower part 206 (e.g., when flanges 243 of upper part 204 are in contact with upper edges 245 of lower part 206 but before upper part 204 and lower part 206 have been secured together). As threaded fasteners 248 are advanced into the threaded apertures 252, the offset between apertures 250 and 252 causes flanges 243 of the side walls 238 of the upper part 204 to be pulled into a tight engagement with the upper edges 245 of the side walls 241 of the lower part 206, thus ensuring a tight coupling of the upper part 204 to the lower part 206.

As illustrated in FIG. 13, in some embodiments, the apertures 250 can be implemented with frustoconical countersinks. In one embodiment, the countersinks can be offset downward or otherwise (e.g., by approximately 8 thousandths of an inch in one embodiment) such that the upper portions of the heads of the threaded fasteners 248 contact the rail 213 and/or the lower part 206 before the threaded fasteners 248 are fully screwed into the threaded apertures 252 and fully seated within the corresponding countersinks. Such contact can provide compressive force to further secure the upper part 204 and the lower part 206 together.

As illustrated in, e.g., FIGS. 12 and 13, selected ones or all of the side walls of the housing 102 can include a pattern of apertures 251 (e.g., in upper part 204) and 259 (e.g., in lower part 206). Apertures 251 and 259 reduce the weight of the second example hand guard 200 substantially, and also permit cooling of the barrel 24 of the rifle 10 during extended firing thereof, thereby ensuring that the hand guard 200 remains cool to the touch.

Additionally, as discussed below, apertures 251 and 259 may be used to implement elongated slots 254A-B to define rails 289 which may be used to mount accessories to the hand guard 200, e.g., such as, for example, rails 262 illustrated in FIGS. 10, 19A, and 19B, the accessory mounting bracket 201 illustrated in FIG. 11, and/or other accessories. In some embodiments, slots 254A may be defined by apertures 251 in inclined side walls 239 of upper part 204 and upper edge 245 of lower part 206. In some embodiments, slots 254B may be defined entirely by apertures 259 in inclined side walls 247 of lower part 206.

Figure 19A:
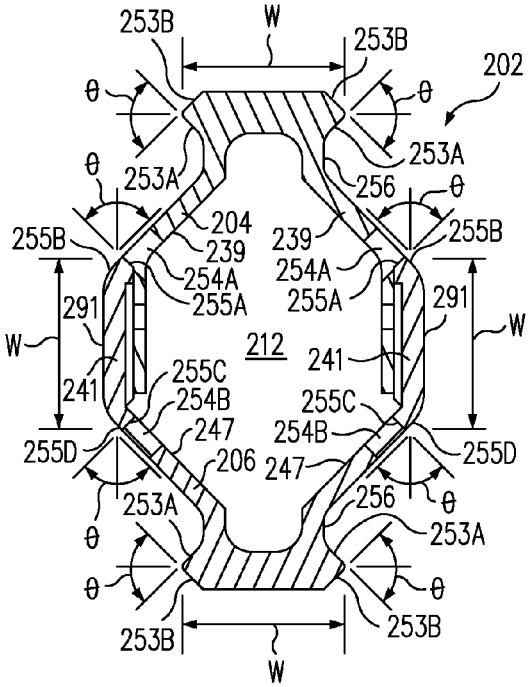
FIGS. 19A-19C are cross-sectional views of the second example hand guard, as seen along the lines of the section 16-16 taken in FIG. 12, showing various accessory and accessory bracket mounting features.
Figure 19B:
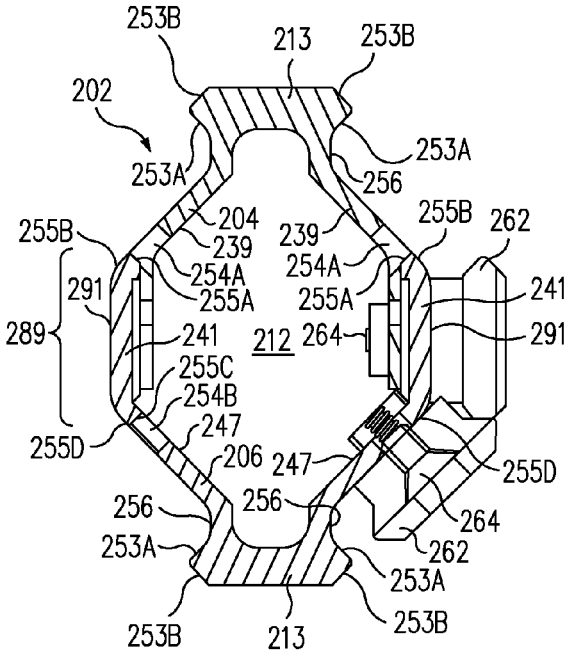
Figure 19C:
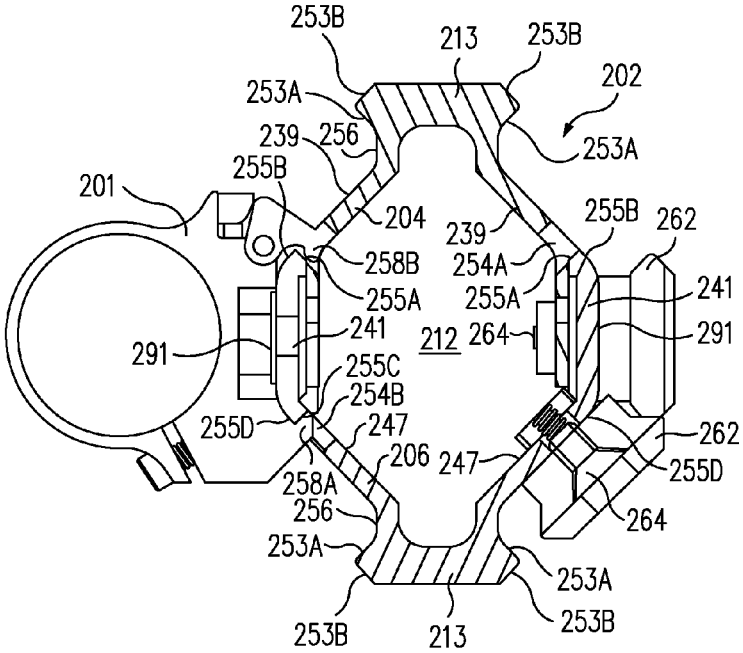

FIGS. 19A-19C are cross-sectional views of the second example hand guard 200, as seen along the lines of the section 16-16 taken in FIG. 12, showing various accessory and accessory bracket mounting features. As discussed above and illustrated in FIGS. 19A-19C, at least one of the side walls of the housing 202 can comprise an integral, longitudinal accessory mounting rail 213, such as specified in MIL-STD-1913 and commonly referred to as a "Picatinny" rail. In the particular example embodiment illustrated in the figures, the housing 202 includes two such integral accessory mounting rails 213, viz., one disposed atop the top wall of the upper part 204 of the housing 202, and one disposed on the bottom wall of the lower part 206 of the housing 202. In this regard, each side of rails 213 include two angulated faces 253A-B (see FIGS. 19A-C) which subtend an angle θ of about 90 degrees, and the width w between the respective intersection of the angulated faces 253A-B on either side of each rail 213 is about 0.835 inches.

Additional side rails 289 may be provided with "Picatinny rail" features, but having a substantially reduced height relative to conventional Picatinny rails 213 (e.g., without the "neck" portion 256 of the conventional Picatinny rail 213). In this regard, rails 289 include angulated faces 255A-B and 255C-D provided on opposite sides of lateral side walls 241 and proximate to slots 254A-B. Slots 254A (e.g., having perimeters defined by apertures 251 in inclined side walls 239 of upper part 204 and upper edge 245 of lower part 206 as discussed) define angulated faces 255A (e.g., interior facing angulated faces corresponding to portions of upper edge 245 of lower part 206). Slots 254B (e.g., having perimeters defined by apertures 259 in inclined side walls 247 of lower part 206 as discussed) define angulated faces 255C (e.g., interior facing angulated faces). External surfaces of lateral side walls 241 may provide angulated faces 255B and 255D (e.g., exterior facing angulated faces).

Angulated faces 255A-B and 255C-D of rails 289 may exhibit the same angle θ and the same width w as described for angulated faces 253A-B of rails 213. However, as can be seen in FIGS. 19A-C, the respective outer surfaces 291 of rails 289 are generally coplanar with the respective outer surfaces of the side walls 241 of the lower part 206. Thus, the "neck" portion 256 of the conventional Picatinny rail 213 is eliminated in rails 289, resulting in a lighter, narrower, easier-to-grip hand guard 200 without any sacrifice in accessory mounting capabilities.

Figure 18A:
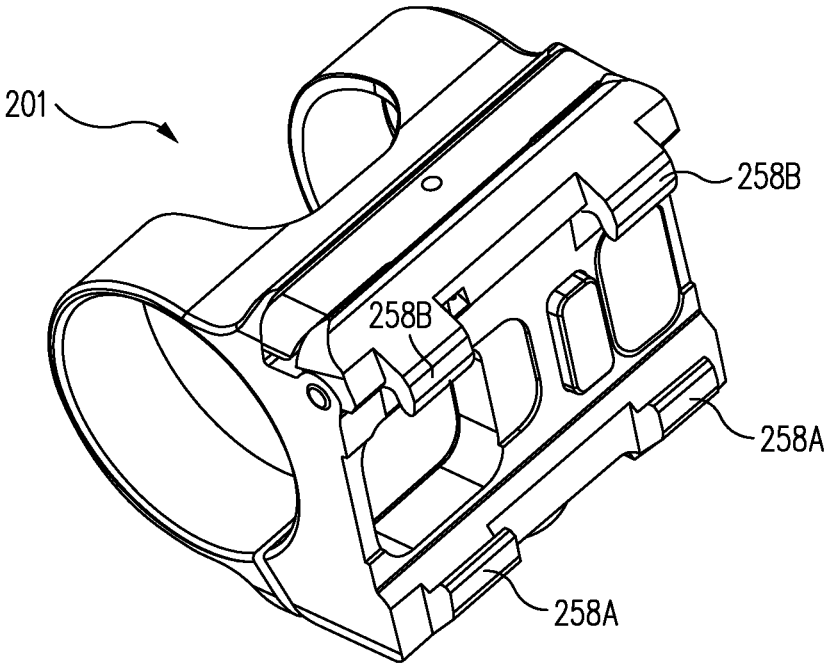
FIG. 18A is an upper, front, left side perspective view of the example accessory mounting bracket of FIG. 11.
Figure 18B:
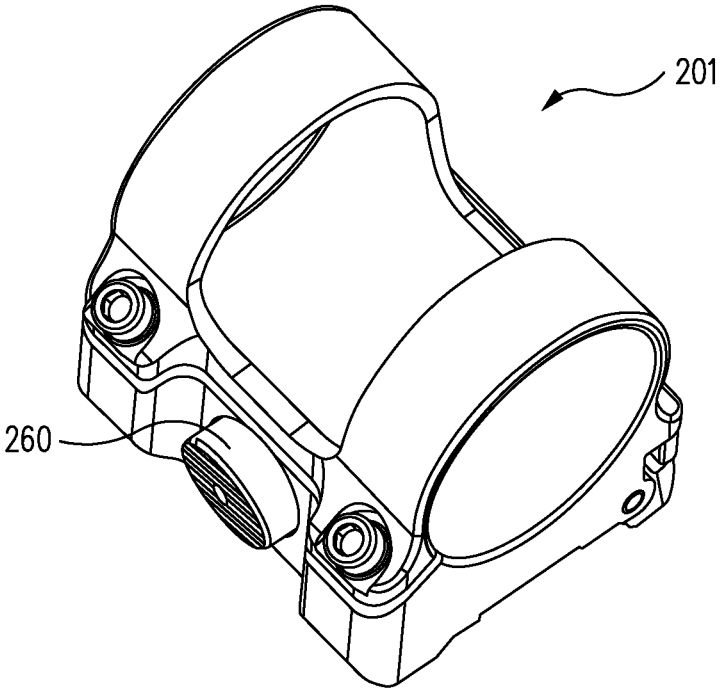
FIG. 18B is an upper, front, right side perspective view of the mounting bracket.

FIG. 18A is an upper, front, left side perspective view of the example accessory mounting bracket 201 shown in FIG. 11, and FIG. 18B is an upper, front, right side perspective view thereof. The bracket 201 can be configured to mount, for example, a light 190 discussed above in connection with FIG. 3. As illustrated in FIG. 18A, in some embodiments, the mounting bracket 201 can comprise two pairs of fingers 258A and 258B configured to engage a Picatinny rail. In some implementations, the pair of fingers 258A can be fixed on the bracket 201 and the other pair of fingers 258B can be arranged to pivot toward and away from the fixed pair 258A, for example, by turning the head of an actuating member 260 of the type illustrated in FIG. 18B. As illustrated in FIG. 19C, this arrangement enables the mounting bracket 201 to be clamped to a side wall (e.g., as fingers 258A-B extend through slots 254 and around side wall 241) of the housing 202 using the "reduced-height" Picatinny rail design discussed above.

If desired, conventional Picatinny accessory mounting rails 262 can be mounted on the outer surfaces of the side walls of the upper and/or lower parts 204 and 206 of the hand guard housing 202 (e.g., mounted on rails 289, using apertures 251 of upper part 204, using apertures 259 of lower part 206, using apertures 261 in lateral side walls 241, and/or others). As illustrated in the figures, these can be mounted to corresponding ones of the side walls using, for example, threaded fasteners 264 (e.g., see FIGS. 19B-C), but it should be understood that they can also be mounted to the housing 202 using other fastening techniques, such as riveting, adhesive bonding and the like.

Figure 21:
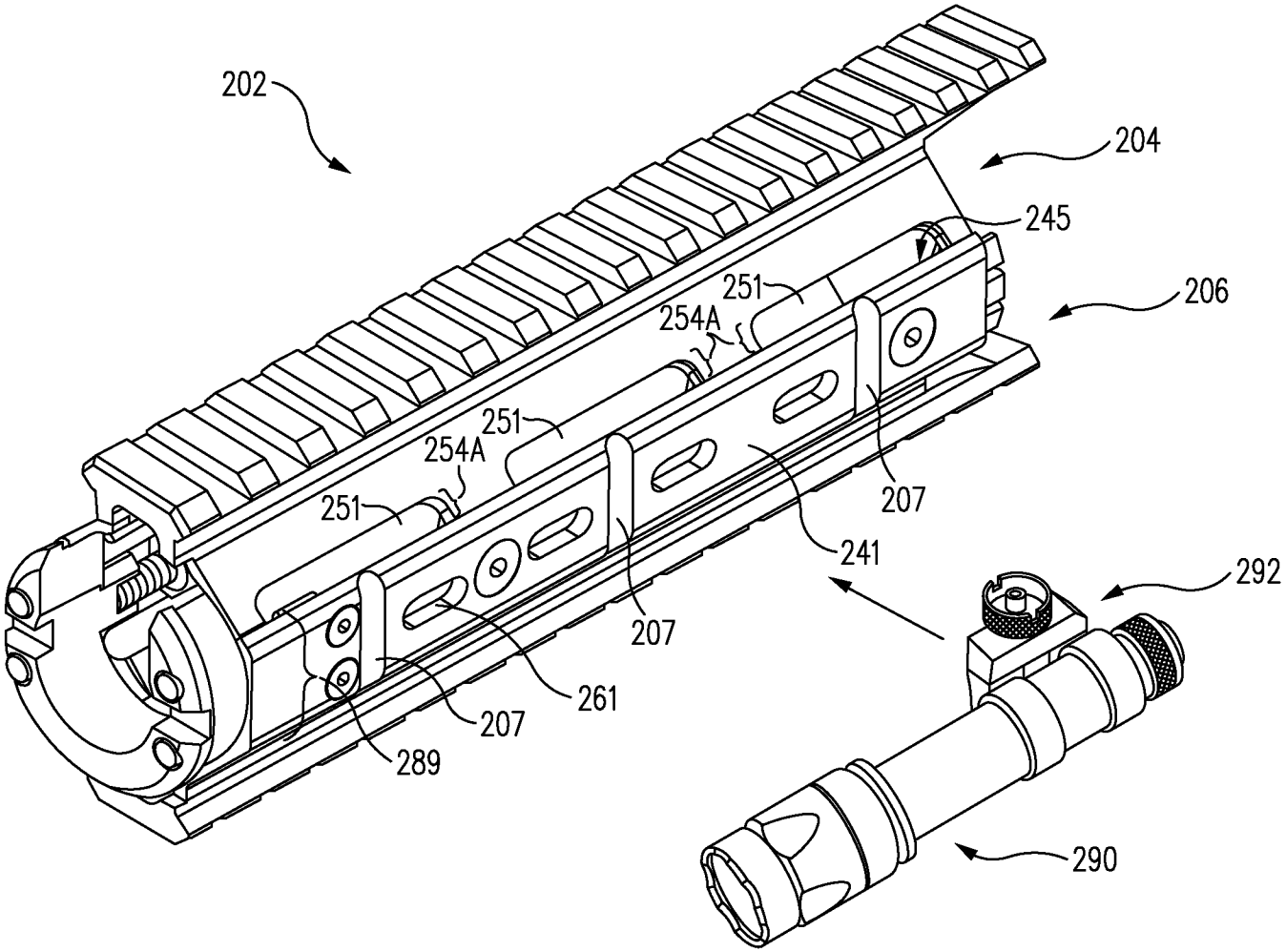
FIG. 21 illustrates a lighting device attached to a clamp mount that may be attached to a lateral side wall of the second example hand guard.

As shown in FIG. 21, side walls 241 of lower part 206 include recesses 207. Recesses 207 may be used to position various types of accessories, such as clamp mounts and/or other devices, on hand guard 200. For example, FIG. 21 illustrates a lighting device 290 (e.g., a SureFire Scout Light in one embodiment) attached to a clamp mount 292. Clamp mount 292 is more clearly shown in the assembled view of FIG. 22 and the exploded view of FIG. 23.

Clamp mount 292 may include a bolt 293, a first clamp member 294, a roll pin 295, a second clamp member 296, a washer 297, a split lock washer 298, and a nut 299. Clamp mount 292 may be installed on a side wall 241 using slots 254 in a similar manner as described with regard to mounting bracket 201. For example, rotation of nut 299 may cause first and second clamp members 294 and 296 to be pulled toward each other to cause at least a flange 296A of second clamp member 296 to extend around side wall 241.

Figure 22:
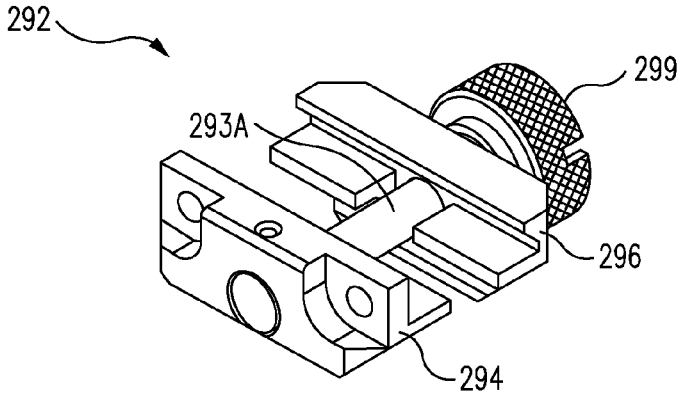
FIG. 22 illustrates the clamp mount of FIG. 21.
Figure 23:
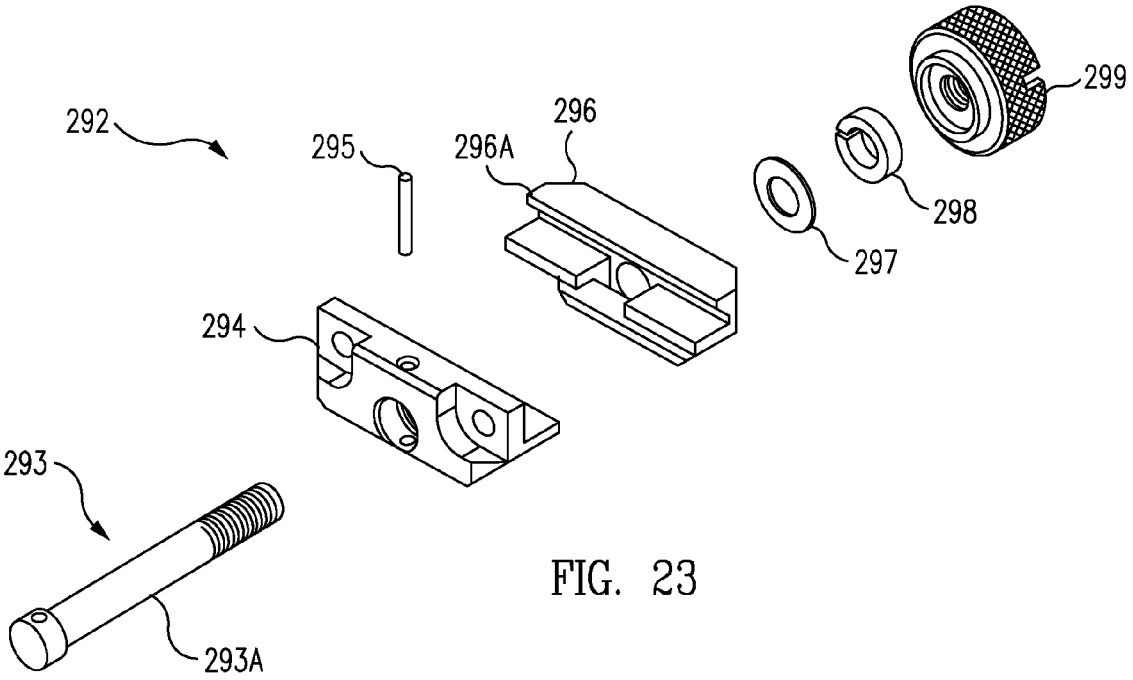
FIG. 23 illustrates an exploded view of the clamp mount of FIG. 21.

As shown in FIG. 22, when clamp mount 292 is assembled, a shank 293A of bolt 293 is exposed. Recesses 207 in side walls 241 may be configured (e.g., having substantially scalloped and/or rounded interior surfaces complimentary to shank 293A) to receive shank 294A while clamp mount 292 is installed. Such engagement of a recess 207 with shank 294A permits clamp mount 292 to be conveniently and rapidly positioned at one or more predetermined positions along (e.g., relative to) side wall 241. Other configurations of recesses 207 and clamp mounts 292 may be used where appropriate.

The foregoing description is presented so as to enable any person skilled in the art to make and use the invention. For purposes of explication, specific nomenclature has been set forth to provide a thorough understanding of the disclosure. However, it should be understood that the descriptions of specific embodiments or applications provided herein are provided only by way of some example embodiments of the invention, and not by way of any limitations thereof. Indeed, various modifications to the embodiments will be readily apparent to those skilled in the art, and the general principles defined herein can be applied to other embodiments and applications without departing from the spirit and scope of the invention. Thus, the present invention should not be limited to the particular embodiments illustrated and described herein, but rather, should be accorded the widest possible scope consistent with the principles and features disclosed herein.

What is claimed is:

1. A hand guard comprising:

an elongated housing comprising:

a lumen configured to substantially surround an intermediate portion of a barrel of a firearm, a side wall, a pair of elongated slots disposed on opposite sides of the side wall, wherein each of the elongated slots defines a corresponding angulated face of a rail adapted to receive an accessory to be mounted thereon, an upper part and a lower part adapted to be releasably coupled together to provide the lumen, and opposite open ends; and an expansion collar disposed at one end of the housing and comprising an expansion mechanism configured to translate the expansion collar longitudinally along the barrel and spread apart from the housing to adjustably compress the expansion collar and the lower part of the housing longitudinally between a pair of oppositely facing surfaces respectively disposed at opposite ends of the intermediate portion of the barrel.

2. The hand guard of claim 1, wherein:

the side wall is a lateral side wall;

the hand guard further comprises an inclined side wall adjacent to and inclined relative to the lateral side wall; and at least one of the slots is provided within the inclined side wall.

3. The hand guard of claim 2, wherein:

the inclined side wall is a first inclined side wall;

the one of the slots is a first one of the slots;

the hand guard further comprises a second inclined side wall adjacent to and inclined relative to the lateral side wall;

the first and second side walls are respectively disposed on opposite sides of the lateral side wall; and at least a portion of a perimeter of a second one of the slots is defined by an edge of the lateral side wall.

4. The hand guard of claim 1, wherein:

the angulated faces are spaced apart by a distance of 0.835 inches; and the angulated faces subtend an angle of 90 degrees.

5. The hand guard of claim 1, further comprising a recess in the side wall adapted to receive a complimentary portion of the accessory to position the accessory relative to the side wall.

6. The hand guard of claim 1, wherein the expansion mechanism is configured to secure the lower part of the housing to the firearm while the upper part of the housing is removed.

7. The hand guard of claim 6, wherein the lower part of the housing is adapted to be positioned above a top surface of the barrel of the firearm while the upper part of the housing is removed.

8. The hand guard of claim 1, wherein the expansion mechanism comprises:

a plurality of longitudinal tongues disposed on the expansion collar and extending toward an adjacent end of the lower part of the housing, each tongue comprising a longitudinal bore comprising a bottom end surface; and a corresponding plurality of longitudinally extending screws adapted to be received in corresponding ones of a corresponding plurality of threaded apertures contained in a corresponding plurality of laterally opposing stanchions respectively attached to inner surfaces of the lower part of the housing, each screw comprising a distal end disposed in abutment with a corresponding one of the bottom end surfaces of the longitudinal bores.

9. The hand guard of claim 8, wherein at least one of the stanchions is attached to one or the inner surfaces of the lower part of the housing by a fastening mechanism comprising a threaded fastener, a rivet, a brazed joint, or an adhesive joint.

10. The hand guard of claim 8, wherein the expansion mechanism further comprises a plurality of elongated compression members extending longitudinally from an end of the expansion collar opposite to the adjacent end of the lower part of the housing.

11. The hand guard of claim 8, further comprising a material positioned between the one end of the housing and at least one of the surfaces, wherein the material is adapted to compress and expand to distribute substantially longitudinal forces over the at least one of the surfaces.

12. The hand guard of claim 1, wherein the upper part comprises a protrusion adapted to extend over at least a portion of a receiver of the firearm while the upper part of the housing is coupled to the lower part of the housing.

13. The hand guard of claim 1, wherein:

the side wall is an upwardly extending side wall;

the lower part of the housing comprises a pair of the upwardly extending side walls and each comprising a generally planar interior surface;

the upper part of the housing comprises a pair of downwardly extending side walls each comprising a generally planar exterior surface; and the downwardly extending side walls of the upper part are disposable inside the upwardly extending side walls of the lower part such that respective ones of the planar exterior surfaces are disposed in facing opposition to corresponding ones of the planar interior surfaces.

14. The hand guard of claim 13, wherein:

the hand guard further comprises a plurality of threaded fasteners respectively extending laterally through openings in corresponding ones of the upwardly extending side walls and into corresponding threaded apertures disposed in corresponding ones of the downwardly extending side walls and arranged such that advancement of the fasteners into the threaded apertures acts to pull the planar exterior surfaces into engagement with corresponding ones of the planar interior surfaces; and the threaded apertures in the downwardly extending side walls are offset from the threaded fasteners such that advancement of the fasteners into the threaded apertures further acts to pull engagement surfaces of the downwardly extending side walls against engagement surfaces of the upwardly extending side walls.

15. The hand guard of claim 1, further comprising at least one longitudinal accessory mounting rail provided by the upper part or the lower part of the housing.

16. The hand guard of claim 15, wherein the longitudinal accessory mounting rail is adapted to be substantially level with a longitudinal accessory mounting rail provided on a receiver of the firearm when the hand guard is installed on the firearm.

17. The hand guard of claim 15, wherein the at least one accessory mounting rail comprises a Picatinny rail.

18. The hand guard of claim 1, wherein the housing has a generally octagonal cross-section.

19. The hand guard of claim 1, further comprising the accessory mounted to the rail.

20. The hand guard of claim 1, wherein the accessory comprises a light or a sighting device.

21. A method of operating the hand guard of claim 1, the method comprising installing the accessory on the rail.

22. The hand guard of claim 1, wherein the expansion mechanism comprises a plurality of screws adapted to be inserted into threaded apertures that are fixed in relation to the housing, wherein the expansion collar is adapted to translate in response to pressure exerted by the screws against the expansion collar.

23. A method comprising:

providing a hand guard comprising:

an elongated housing comprising:

a lumen configured to substantially surround an intermediate portion of a barrel of a firearm, a side wall, a pair of elongated slots disposed on opposite sides of the side wall, wherein each of the elongated slots defines a corresponding angulated face of a rail adapted to receive an accessory to be mounted thereon, an upper part and a lower part adapted to be releasably coupled together to provide the lumen, and opposite open ends, and an expansion collar disposed at one end of the housing and comprising an expansion mechanism configured to translate the expansion collar longitudinally along the barrel and spread apart from the housing to adjustably compress the expansion collar and the lower part of the housing longitudinally between a pair of oppositely facing surfaces respectively disposed at opposite ends of the intermediate portion of the barrel;

inserting at least a portion of the expansion collar into one of the ends of the housing to form an assembly;

positioning the assembly over an intermediate portion of the barrel of the firearm and between opposing surfaces thereon; and adjusting the expansion mechanism of the expansion collar such that the assembly is held in compression between the opposing surfaces by advancing a plurality of longitudinally extending screws respectively received in corresponding ones of a plurality of bores contained in the expansion collar such that a distal end of each screw is disposed in abutment with a bottom end surface of a corresponding one of the bores and at least a portion of each screw is loaded in compression.

24. The method of claim 23, wherein the upper part of the housing is positioned above a top surface of the barrel of the firearm while the assembly is held in compression.

25. The method of claim 23, wherein:

the positioning comprises positioning the assembly substantially over a top surface of the barrel of the firearm; and the method further comprises rotating the assembly to a position substantially below a bottom surface of the barrel of the firearm prior to the adjusting.

26. The method of claim 23, further comprising distributing longitudinal forces over at least one of the opposing surfaces by compression and expansion of a material positioned between the one of the ends of the housing and the at least one of the opposing surfaces.

27. The method of claim 23, further comprising:

inserting at least a portion of the upper part of the housing into the lower part of the housing and over the intermediate portion of the barrel of the firearm; and coupling the upper part of the housing to the lower part of the housing.

28. The method of claim 27, wherein the coupling comprises advancing a plurality of threaded fasteners into corresponding threaded apertures such that advancement of the fasteners into the threaded apertures acts to pull the upper part of the housing down toward the lower part of the housing.

29. The method of claim 23, wherein:

the side wall is a lateral side wall;

the housing further comprises an inclined side wall adjacent to and inclined relative to the lateral side wall; and at least one of the slots is provided within the inclined side wall.

30. The method of claim 29, wherein:

the inclined side wall is a first inclined side wall;

the one of the slots is a first one of the slots;

the housing further comprises a second inclined side wall adjacent to and inclined relative to the lateral side wall;

the first and second side walls are respectively disposed on opposite sides of the lateral side wall; and at least a portion of a perimeter of a second one of the slots is defined by an edge of the lateral side wall.

31. The method of claim 23, wherein:

the angulated faces are spaced apart by a distance of 0.835 inches; and the angulated faces subtend an angle of 90 degrees.

32. The method of claim 23, further comprising mounting the accessory on the rail.

33. The method of claim 23, wherein the side wall comprises a recess adapted to receive a complimentary portion of the accessory to position the accessory relative to the side wall.

34. The method of claim 23, wherein the expansion mechanism comprises a plurality of screws adapted to be inserted into threaded apertures that are fixed in relation to the housing, wherein the expansion collar is adapted to translate in response to pressure exerted by the screws against the expansion collar.

* * * * *